US009801471B2

(12) United States Patent
Machael et al.

(10) Patent No.: US 9,801,471 B2
(45) Date of Patent: Oct. 31, 2017

(54) CHAIR AND CHAIR CONTROL ASSEMBLIES, SYSTEMS, AND METHODS

(71) Applicant: HNI Technologies Inc., Muscatine, IA (US)

(72) Inventors: Jay R. Machael, Muscatine, IA (US); Matthew R. Lindorfer, Roseville, MN (US); Brandt M. Heitman, Muscatine, IA (US); Jesse Hahn, Cedar Rapids, IA (US)

(73) Assignee: HNI Technologies Inc., Muscatine, IA (US)

( * ) Notice: Subject to any disclaimer, the term of this patent is extended or adjusted under 35 U.S.C. 154(b) by 186 days.

(21) Appl. No.: 14/690,139

(22) Filed: Apr. 17, 2015

(65) Prior Publication Data

US 2015/0296988 A1 Oct. 22, 2015

Related U.S. Application Data

(60) Provisional application No. 61/981,071, filed on Apr. 17, 2014.

(51) Int. Cl.

| | |
|---|---|
| ***A47C 1/032*** | (2006.01) |
| ***A47C 3/20*** | (2006.01) |
| ***A47C 7/00*** | (2006.01) |

(52) U.S. Cl.

CPC ..... *A47C 3/20* (2013.01); *A47C 1/03233* (2013.01); *A47C 1/03238* (2013.01); *A47C 1/03255* (2013.01); *A47C 1/03294* (2013.01); *A47C 7/004* (2013.01)

(58) Field of Classification Search

CPC ..... A47C 1/03294; A47C 1/03272; A47C 1/03255; A47C 1/03233; A47C 1/03238

See application file for complete search history.

(56) References Cited

U.S. PATENT DOCUMENTS

| | | | |
|---|---|---|---|
| 45,050 | A | 11/1864 | Kimball |
| 467,756 | A | 1/1892 | Sandburg |
| 1,909,018 | A | 5/1933 | Sengpiel |
| 2,227,717 | A | 1/1941 | Jones |
| 2,321,385 | A | 6/1943 | Herold |
| 2,324,902 | A | 7/1943 | Berizick et al. |

(Continued)

FOREIGN PATENT DOCUMENTS

| | | | |
|---|---|---|---|
| BE | 483388 | A | 7/1948 |
| CA | 2415728 | A1 | 7/2003 |

(Continued)

OTHER PUBLICATIONS

International Preliminary Report on Patentability issued in PCT/US2015/026514, mailed Oct. 27, 2016, 8 pages.

(Continued)

*Primary Examiner* — Timothy J Brindley

(74) *Attorney, Agent, or Firm* — Faegre Baker Daniels LLP

(57) ABSTRACT

Chairs, seating systems, chair sub-assemblies and sub-systems, and associated methods of assembly and use. Aspects relate to chairs and methods of assembling chairs including chair controls of a relatively compact and effective design with desirable synchronous raising and tilting motions. Aspects also relate to tilt lock assemblies for achieving secure and effective tilt securement. Additional aspects relate to forward and rearward adjustment, or extension and retraction, of a seating assembly of the chair.

18 Claims, 22 Drawing Sheets

(56) References Cited

U.S. PATENT DOCUMENTS 2,374,350 A 4/1945 Herold
2,456,797 A 12/1948 Sheldrick
2,471,024 A 5/1949 Cramer
2,494,779 A 1/1950 Prosser et al.
2,497,395 A 2/1950 Cramer, Sr.
2,509,739 A 5/1950 Mcdonald
2,619,153 A 11/1952 Van Osselen
2,660,222 A 11/1953 Woodsworth
2,725,921 A 12/1955 Morris
2,735,476 A 2/1956 Fielber
2,764,224 A 9/1956 Maurer
2,778,408 A 1/1957 Krikorian
2,789,650 A 4/1957 Krous
2,818,909 A 1/1958 Burnett
2,823,730 A 2/1958 Lawrence
2,826,241 A 3/1958 Himka
2,838,095 A 6/1958 Deaton
2,859,799 A 11/1958 Moore
2,859,801 A 11/1958 Moore
2,883,206 A 4/1959 Racine
2,884,992 A 5/1959 Martin et al.
2,918,113 A 12/1959 Lorenz
2,940,510 A 6/1960 Schliephacke
2,947,347 A 8/1960 Spound
2,970,862 A 2/1961 Racine
2,978,273 A 4/1961 Racine
3,034,828 A 5/1962 Kurihara
3,092,415 A 6/1963 Schliephacke
3,102,753 A 9/1963 Schliephacke
3,333,811 A 8/1967 Matthews
3,337,267 A 8/1967 Rogers, Jr.
3,356,413 A 12/1967 Hall et al.
3,359,035 A 12/1967 Schiffman
3,363,942 A 1/1968 Fletcher
3,369,840 A 2/1968 Dufton
3,394,965 A 7/1968 Fletcher
3,399,906 A 9/1968 Portnoff
3,460,791 A 8/1969 Judd
3,463,543 A 8/1969 Zellar
3,552,795 A 1/1971 Perkins et al.
3,645,548 A 2/1972 Briner
3,697,128 A 10/1972 Faust et al.
3,731,972 A 5/1973 Mcconnell
3,853,298 A 12/1974 Libkie et al.
3,858,930 A 1/1975 Calandra et al.
3,897,036 A 7/1975 Nystrom
3,916,461 A 11/1975 Kerstholt
3,941,417 A 3/1976 Re
3,947,069 A 3/1976 Lusch
4,042,276 A 8/1977 Breitschwerdt
4,270,798 A 6/1981 Harder et al.
4,301,983 A 11/1981 Horan
4,408,800 A 10/1983 Knapp
4,411,469 A 10/1983 Drabert et al.
4,429,917 A 2/1984 Diffrient
4,456,297 A 6/1984 Pietschmann et al.
D274,675 S 7/1984 Diffrient
4,478,454 A 10/1984 Faiks
4,479,679 A 10/1984 Fries et al.
4,502,729 A 3/1985 Locher
4,533,177 A 8/1985 Latone
4,629,249 A 12/1986 Yamaguchi
4,634,169 A 1/1987 Hasstedt
4,640,548 A 2/1987 Desanta
4,668,012 A 5/1987 Locher
4,681,369 A 7/1987 Simpson
4,682,814 A 7/1987 Hansen
4,684,173 A 8/1987 Locher
4,685,730 A 8/1987 Linguanotto
4,685,733 A 8/1987 Machate et al.
4,687,250 A 8/1987 Esche
4,693,514 A 9/1987 Volkle
4,709,962 A 12/1987 Steinmann
4,732,424 A 3/1988 Uredat-Neuhoff
4,740,031 A 4/1988 Rogers et al.
4,761,033 A 8/1988 Lanuzzi et al.
4,773,706 A 9/1988 Hinrichs
4,779,925 A 10/1988 Heinzel
4,789,203 A 12/1988 van Zee et al.
4,796,952 A 1/1989 Piretti
4,834,454 A 5/1989 Dicks
4,848,198 A 7/1989 Royal et al.
4,848,837 A 7/1989 Volkle
4,906,045 A 3/1990 Hofman
4,943,114 A 7/1990 Piretti
4,962,962 A 10/1990 Machate et al.
4,966,411 A 10/1990 Katagiri et al.
4,979,778 A 12/1990 Shields
4,988,145 A 1/1991 Engel
5,007,678 A 4/1991 DeKraker
5,018,787 A 5/1991 Estkowski et al.
5,071,189 A 12/1991 Kratz
5,080,318 A 1/1992 Takamatsu et al.
5,080,435 A 1/1992 Desanta
5,110,182 A 5/1992 Beauvais
5,112,044 A 5/1992 Dubats
5,150,948 A 9/1992 Volkle
5,152,580 A 10/1992 Stumpf
5,195,801 A 3/1993 Franck et al.
5,203,853 A 4/1993 Caruso
5,207,479 A 5/1993 Wickman et al.
5,214,360 A 5/1993 Gonser et al.
5,224,758 A 7/1993 Takamatsu et al.
5,234,187 A 8/1993 Teppo et al.
5,251,958 A 10/1993 Roericht et al.
5,261,723 A 11/1993 Hosoe
5,261,727 A 11/1993 Klaebel
5,288,138 A 2/1994 Stulik et al.
5,292,097 A 3/1994 Russell
5,308,144 A 5/1994 Korn
5,318,345 A 6/1994 Olson
5,324,900 A 6/1994 Gonser et al.
5,328,237 A 7/1994 Yamaguchi et al.
5,348,372 A 9/1994 Takamatsu et al.
5,354,120 A 10/1994 Volkle
5,366,269 A 11/1994 Beauvais
5,370,445 A 12/1994 Golynsky
5,383,712 A 1/1995 Perry
5,388,889 A 2/1995 Golynsky
5,397,165 A 3/1995 Grin et al.
5,417,473 A 5/1995 Brauning
5,423,594 A 6/1995 Hancock et al.
5,462,333 A 10/1995 Beauvais
5,464,274 A 11/1995 Golynsky et al.
5,486,035 A 1/1996 Koepke et al.
5,551,751 A 9/1996 Sedlack et al.
5,573,303 A 11/1996 Doerner
5,575,095 A 11/1996 Korn
5,582,459 A 12/1996 Hama et al.
5,584,533 A 12/1996 Schrewe
5,605,372 A 2/1997 Al-Abdullateef
5,628,547 A 5/1997 Matsumiya
5,630,643 A 5/1997 Scholten et al.
5,630,647 A 5/1997 Heidmann et al.
5,634,688 A 6/1997 Ellis
5,664,830 A 9/1997 Garcia et al.
5,676,425 A 10/1997 Pernicka
5,683,139 A 11/1997 Golynsky et al.
5,683,142 A 11/1997 Gunderson et al.
5,695,245 A 12/1997 Carlson et al.
5,725,276 A 3/1998 Ginat
5,733,005 A 3/1998 Aufrere et al.
5,765,893 A 6/1998 Ziegler
5,775,774 A 7/1998 Okano
5,782,536 A 7/1998 Heidmann et al.
5,810,439 A 9/1998 Roslund et al.
5,810,440 A 9/1998 Unwalla
5,826,940 A 10/1998 Hodgdon
5,871,258 A 2/1999 Battey et al.
5,873,634 A 2/1999 Heidmann et al.
5,888,212 A 3/1999 Petrofsky et al.
5,918,935 A 7/1999 Stulik et al.
5,931,531 A 8/1999 Assmann
5,934,758 A 8/1999 Ritch et al.

(56) References Cited

U.S. PATENT DOCUMENTS 5,957,534 A 9/1999 Wilkerson et al.
5,964,502 A 10/1999 Stephens
5,964,503 A 10/1999 Inoue
5,971,484 A 10/1999 Lamart et al.
5,979,984 A 11/1999 DeKraker et al.
5,979,985 A 11/1999 Bauer et al.
5,979,988 A 11/1999 Heidmann et al.
5,988,743 A 11/1999 Drexler
D417,568 S 12/1999 Pike
6,000,753 A 12/1999 Cone, II
6,000,755 A 12/1999 Uhlenbrock
6,000,756 A 12/1999 Hybarger et al.
6,007,150 A 12/1999 Clerkin et al.
6,010,189 A 1/2000 Hybarger et al.
6,015,189 A 1/2000 Broadhead et al.
6,027,168 A 2/2000 Crossman et al.
6,027,169 A 2/2000 Roslund et al.
6,056,361 A 5/2000 Cvek
6,086,153 A 7/2000 Heidmann et al.
6,102,477 A 8/2000 Kurtz
6,109,694 A 8/2000 Kurtz
6,113,642 A 9/2000 Petrofsky et al.
6,116,688 A 9/2000 Wilkerson et al.
6,116,695 A 9/2000 Heidmann et al.
D432,338 S 10/2000 Matern
6,139,101 A 10/2000 Berringer et al.
6,139,103 A 10/2000 Hybarger et al.
6,152,525 A 11/2000 Carine et al.
6,199,952 B1 3/2001 Davis
6,203,107 B1 3/2001 Jonsson
6,209,963 B1 4/2001 Gust et al.
6,213,552 B1 4/2001 Miotto
6,234,573 B1 5/2001 Röder et al.
6,247,753 B1 6/2001 Alvestad
6,250,715 B1 6/2001 Caruso et al.
6,290,296 B1 9/2001 Beggs
6,305,644 B1 10/2001 Beroth
6,318,799 B1 11/2001 Greger et al.
6,319,585 B1 11/2001 Coronado
6,352,309 B1 3/2002 Beroth
6,356,210 B1 3/2002 Ellis
6,367,876 B2 4/2002 Caruso et al.
6,386,634 B1 5/2002 Stumpf et al.
6,394,548 B1 5/2002 Battey et al.
6,394,549 B1 5/2002 DeKraker et al.
6,419,318 B1 7/2002 Albright
6,425,633 B1 7/2002 Wilkerson et al.
6,428,099 B1 8/2002 Kain
6,431,649 B1 8/2002 Hensel
6,454,350 B1 9/2002 Celestina-Krevh et al.
6,460,932 B1 10/2002 Kopish et al.
6,474,737 B1 11/2002 Canteleux et al.
6,488,332 B1 12/2002 Markwald
6,494,538 B1 12/2002 Alvestad
D468,940 S 1/2003 Chen
6,511,128 B2 1/2003 Piretti
6,513,874 B1 2/2003 Sander et al.
6,523,896 B1 2/2003 Uhlenbrock
D472,081 S 3/2003 Chen
6,572,483 B1 6/2003 Hoffman
6,582,019 B2 6/2003 Insalaco et al.
6,588,845 B2 7/2003 Wilkerson et al.
6,598,936 B1 7/2003 Klein
6,607,244 B2 8/2003 Stulik et al.
6,609,755 B2 8/2003 Koepke et al.
6,609,760 B1 8/2003 Matern et al.
6,619,740 B2 9/2003 Beggs
6,637,072 B2 10/2003 Footitt et al.
D483,582 S 12/2003 Chen
6,659,555 B1 12/2003 Scholz et al.
6,669,292 B2 12/2003 Koepke et al.
6,688,690 B2 2/2004 Watson et al.
6,692,075 B2 2/2004 Sander et al.
6,692,077 B1 2/2004 Beggs et al.
6,705,676 B1 3/2004 Berringer et al.
6,705,677 B2 3/2004 Oshima et al.
6,709,057 B2 3/2004 Sander et al.
6,709,058 B1 3/2004 Diffrient
6,729,688 B2 5/2004 Erne
6,779,847 B2 8/2004 Klein
6,802,566 B2 10/2004 Prince et al.
6,817,667 B2 11/2004 Pennington et al.
6,820,935 B1 11/2004 Cioncada
6,820,936 B2 11/2004 Wilkerson et al.
6,840,582 B2 1/2005 Burwell et al.
6,860,564 B2 3/2005 Reed et al.
6,863,345 B2 3/2005 Kain
6,863,346 B2 3/2005 Zund
6,874,852 B2 4/2005 Footitt
6,880,886 B2 4/2005 Bodnar et al.
6,886,888 B2 5/2005 Bock
6,890,030 B2 5/2005 Wilkerson et al.
6,896,329 B2 5/2005 Sander et al.
6,908,159 B2 6/2005 Prince et al.
6,910,741 B2 6/2005 Footitt
6,913,316 B2 7/2005 Kinoshita et al.
6,921,133 B2 7/2005 Taoka et al.
6,932,430 B2 8/2005 Bedford et al.
6,945,602 B2 9/2005 Fookes et al.
6,945,605 B2 9/2005 Kinoshita et al.
6,959,965 B2 11/2005 Diffrient
6,966,604 B2 11/2005 Stumpf et al.
6,969,116 B2 11/2005 Machael et al.
7,004,543 B2 2/2006 Caruso et al.
7,029,071 B2 4/2006 Watson et al.
7,040,703 B2 5/2006 Sanchez
7,048,335 B2 5/2006 Norman et al.
7,066,538 B2 6/2006 Machael et al.
7,080,884 B2 7/2006 Daeschle et al.
7,090,296 B2 8/2006 Massimo
7,114,777 B2 10/2006 Knoblock et al.
7,134,717 B2 11/2006 Thunnissen et al.
7,165,811 B2 1/2007 Bodnar et al.
7,207,629 B2 4/2007 Goetz et al.
D543,388 S 5/2007 Machael et al.
7,226,130 B2 6/2007 Tubergen et al.
7,234,772 B2 6/2007 Wells
7,246,855 B2 7/2007 Langmaid et al.
D547,978 S 8/2007 Machael et al.
D548,992 S 8/2007 Koepke et al.
7,261,368 B1 8/2007 Clausnitzer
D549,977 S 9/2007 Koepke et al.
D550,467 S 9/2007 Koepke et al.
7,264,311 B2 9/2007 Heidmann
7,281,764 B2 10/2007 Thole
RE39,961 E 12/2007 Petrofsky et al.
D558,994 S 1/2008 Machael et al.
7,341,233 B2 3/2008 McMains
7,360,835 B2 4/2008 Tubergen et al.
D568,074 S 5/2008 Koepke et al.
7,377,587 B1 5/2008 Guillot
7,380,881 B2 6/2008 Freed et al.
7,396,081 B2 7/2008 Matern et al.
7,396,082 B2 7/2008 Sanchez
7,401,858 B2 7/2008 Lee
7,419,210 B2 9/2008 Nolan et al.
7,427,105 B2 9/2008 Dammermann et al.
7,441,839 B2 10/2008 Pennington et al.
7,455,360 B2 11/2008 White et al.
7,478,880 B2 1/2009 Johnson et al.
7,497,516 B2 3/2009 Wullum
7,566,097 B2 7/2009 Sander et al.
7,568,763 B2 8/2009 Bedford et al.
D600,051 S 9/2009 Parker et al.
D601,827 S 10/2009 Parker et al.
7,597,396 B2 10/2009 Longenecker et al.
7,600,814 B2 10/2009 Link
D604,535 S 11/2009 Parker et al.
7,614,697 B1 11/2009 Lai
D604,969 S 12/2009 Parker et al.
7,625,046 B2 12/2009 Sanchez
7,654,974 B2 2/2010 Bass
7,669,921 B2 3/2010 Hoffman et al.
7,681,952 B2 3/2010 Piretti

(56) References Cited

U.S. PATENT DOCUMENTS

| | | | |
|---|---|---|---|
| D613,084 | S | 4/2010 | Wilkinson et al. |
| 7,699,393 | B2 | 4/2010 | Forbes et al. |
| D615,784 | S | 5/2010 | Parker et al. |
| D616,213 | S | 5/2010 | Parker et al. |
| 7,714,880 | B2 | 5/2010 | Johnson |
| 7,717,515 | B2 | 5/2010 | Saez et al. |
| 7,735,923 | B2 | 6/2010 | Roslund et al. |
| 7,766,426 | B2 | 8/2010 | Meidan |
| 7,770,973 | B2 | 8/2010 | Gehner et al. |
| 7,784,870 | B2 | 8/2010 | Machael et al. |
| 7,794,016 | B1 | 9/2010 | Lucci et al. |
| 7,798,573 | B2 | 9/2010 | Pennington et al. |
| 7,802,847 | B2 | 9/2010 | Chou |
| 7,806,478 | B1 | 10/2010 | Cvek |
| 7,837,265 | B2 | 11/2010 | Machael et al. |
| 7,857,390 | B2 | 12/2010 | Schmitz et al. |
| 7,971,936 | B2 | 7/2011 | Fukai |
| 7,980,631 | B2 | 7/2011 | Diffrient |
| 7,992,937 | B2 | 8/2011 | Plikat et al. |
| 7,997,652 | B2 | 8/2011 | Roslund et al. |
| 8,025,334 | B2 | 9/2011 | Schmitz et al. |
| 8,029,060 | B2 | 10/2011 | Parker et al. |
| 8,029,061 | B2 | 10/2011 | Fukai |
| 8,056,975 | B2 | 11/2011 | Longenecker et al. |
| 8,061,775 | B2 | 11/2011 | Diffrient |
| 8,075,058 | B2 | 12/2011 | Baumann |
| 8,087,727 | B2 | 1/2012 | Parker et al. |
| 8,096,615 | B2 | 1/2012 | Parker et al. |
| 8,100,061 | B2 | 1/2012 | Hookway et al. |
| 8,104,837 | B2 | 1/2012 | Diffrient |
| D660,056 | S | 5/2012 | Diffrient |
| D661,135 | S | 6/2012 | Diffrient |
| 8,215,710 | B2 | 7/2012 | Erker |
| 8,240,771 | B2 | 8/2012 | Diffrient |
| 8,262,162 | B2 | 9/2012 | Castro et al. |
| 8,272,692 | B1 | 9/2012 | Epperson |
| 8,272,693 | B2 | 9/2012 | Hall et al. |
| 8,297,701 | B2 | 10/2012 | Machael et al. |
| D673,401 | S | 1/2013 | Diffrient |
| 8,353,558 | B2 | 1/2013 | Okamoto et al. |
| 8,613,482 | B2 | 12/2013 | Ni |
| 2001/0000939 | A1 | 5/2001 | Roslund et al. |
| 2002/0041118 | A1 | 4/2002 | Howell |
| 2004/0245839 | A1 | 12/2004 | Bodnar et al. |
| 2009/0015047 | A1 | 1/2009 | Baumann |
| 2009/0146476 | A1 | 6/2009 | Kan et al. |
| 2010/0164263 | A1 | 7/2010 | Malenotti |
| 2011/0062759 | A1 | 3/2011 | Härtel |
| 2011/0074197 | A1 | 3/2011 | Okamoto |
| 2011/0109141 | A1 | 5/2011 | Molnar |
| 2011/0193384 | A1 | 8/2011 | Ni |
| 2011/0304192 | A1 | 12/2011 | Augustat |
| 2013/0313883 | A1 | 11/2013 | Machael et al. |

FOREIGN PATENT DOCUMENTS

| | | | |
|---|---|---|---|
| CN | 2495197 | Y | 6/2006 |
| CN | 201200145 | Y | 3/2009 |
| CN | 201200146 | Y | 3/2009 |
| CN | 201200147 | Y | 3/2009 |
| CN | 201200154 | Y | 3/2009 |
| CN | 201468573 | U | 5/2010 |
| CN | 201468574 | U | 5/2010 |
| CN | 201492054 | U | 6/2010 |
| CN | 201542121 | U | 8/2010 |
| CN | 201630697 | U | 11/2010 |
| CN | 201683406 | U | 12/2010 |
| CN | 201683438 | U | 12/2010 |
| CN | 201691434 | U | 1/2011 |
| CN | 201743286 | U | 2/2011 |
| CN | 201847194 | U | 6/2011 |
| CN | 202207002 | U | 5/2012 |
| CN | 202287211 | U | 7/2012 |
| EP | 1325693 | B1 | 10/2006 |
| EP | 1992255 | A1 | 11/2008 |
| EP | 2409602 | A3 | 1/2013 |
| JP | S61207256 | | 12/1986 |
| WO | 2015161281 | A1 | 10/2015 |

OTHER PUBLICATIONS

International Search Report and Written Opinion issued in PCT/US2015/026514, mailed Jun. 23, 2015, 10 pages.

CHAIR AND CHAIR CONTROL ASSEMBLIES, SYSTEMS, AND METHODS

CROSS-REFERENCE TO RELATED APPLICATION

This application claims priority to Provisional Application No. 61/981,071, filed Apr. 17, 2014, which is herein incorporated by reference in its entirety.

BACKGROUND

Seating functionality, such as office and residential seating, is enhanced by chair motion including the chair seat lifting as the chair back reclines. Various controller designs for chair motion, including weight-activated motion and synchrotilt motion, for example, have been proposed. Various examples of controller designs are described in U.S. Publication 2013/0313883 by Machael et al., published Nov. 28, 2013, and entitled "Chair with Pivot Function and Method of Making"; U.S. Pat. No. 8,613,482 by Yong-Xing Ni, published Dec. 24, 2013 and entitled "Chair Chassis"; and European Publication EP 2 409 602 A by Yong-Xing Ni, published Jan. 25, 2012 and entitled "Rolling Axis Adjusted Tilt Chair Mechanism."

SUMMARY

Some aspects of the instant disclosure relate to chairs, seating systems, chair sub-assemblies and sub-systems, and associated methods of assembly and use. Some aspects relate to chairs and methods of assembling chairs including chair controls of a relatively compact and effective design with desirable synchronous raising and tilting motions. The instant disclosure also relates, in part, to tilt lock assemblies for achieving secure and effective tilt securement. Additional aspects relate to forward and rearward adjustment, or extension and retraction, of a seating assembly of the chair. While various aspects are shown and described in the instant disclosure by way of example, the claims are intended to given their full breadth, including aspects not expressly discussed, but made apparent by the instant disclosure.

Some aspects of the instant disclosure relate to a chair control cartridge including a seat support, a link arm, and a control body. In some embodiments, the seat support includes a first rider and a second rider. The link arm includes an arm body and a pivot link, the arm body having a first end and a second end. The second end of the arm body is pivotably coupled to the pivot link and the pivot link is pivotably coupled to the seat support. The control body has a first slot and a second slot, each of the first and second slots extending upwardly and rearwardly. The first slot receives the first rider of the seat support and the second slot receives the second rider of the seat support. Upon pivoting the arm body relative to the control body the riders of the seat support traverse the first and second slots of the control body, respectively, to raise and lower the seat support. The pivot link is pivotably coupled to the first rider and an intermediate location on the arm body is pivotably coupled to the control body toward a rear location on the control body.

In other embodiments, the control body additionally or alternatively includes one or more riders and the seat support has one or more slots for receiving the one or more riders. In different terms, the complementary slot(s) and rider(s) previously describes are located as desired on either the seat support or the control body to accomplish raising and lower of the seat support of the control cartridge. In some embodiments, each of the first and second slots is located in the seat support, the first and second slots extending upwardly and rearwardly. The first slot receives the first rider of the control body and the second slot receives the second rider of the control body. If desired, the first slot is located in the control body and the first rider is located on the seat support and the second slot is located in the seat support and the second rider is located on the control body (or vice versa). Upon pivoting of the body of the link arm relative to the control body, the riders traverse the slots, respectively to raise and lower the seat support. In still other embodiments, three, four, or more riders and complementary slots are implemented.

In some embodiments, one or more of the riders include a hub and a slider that is rotatably secured to the hub such that the particular rider is rotatably secured to the control body or seat support. In some embodiments, one or more of the riders includes a slider that is non-rotatably, or fixedly secured to the control body or seat support.

In some embodiments, the body of the link arm extends rearwardly relative to the control body to provide a back support attachment location. For example, a back mount is optionally secured to the arm body and the back mount is secured to the back assembly.

In some embodiments, the first slot extends in a first direction and the second slot extends in a second direction, the first direction being angularly offset from the second direction. In some embodiments, the first and second slots extend in substantially parallel directions.

In some embodiments, the pivot link rotates in a first rotational direction upon rotation of the arm body in a second rotational direction that is opposite to the first rotational direction.

In some embodiments, the first and second riders travel in substantially linear paths in the first and second slots, respectively.

In some embodiments, the seat support includes a front end and a rear end, where the front end of the seat support is raised and lowered at greater rate than the rear end of the seat support such that the seat support is tilted rearwardly upon raising the seat support.

Some aspects of the instant disclosure relate to a seating system, chair assembly, or chair according to one or more of the described embodiments. In some embodiments, the chair includes a control assembly including one or more chair control cartridges according to one or more of the described embodiments. In some embodiments, the chair includes a base assembly operatively coupled to the control assembly for maintaining the chair assembly relative to a floor surface, a seat assembly operatively coupled to the control assembly, and a back assembly operatively coupled to the control assembly.

In some embodiments, the slots of the control cartridge(s) extend at an inclined, non-zero angle relative to the floor surface on which the base assembly is configured to maintain the chair. In some embodiments, the control assembly includes the first chair control cartridge and a second control cartridge according to one or more of the previously described control cartridges. The first control cartridge is optionally positioned toward a first side of the seat and the second control cartridge is optionally positioned toward a second side of the seat, the first and second control cartridges being coupled to the seat assembly and the back assembly.

Some aspects of the instant disclosure relate to a method of making or assembling the seating system, chair assembly, or chair according to one or more of the embodiments previously described. In some embodiments, the method includes assembling the chair control assembly, operatively coupling the chair control assembly to the base assembly, operatively coupling the seat assembly to the control assembly, and operatively coupling a back assembly to the chair control assembly.

While multiple embodiments are specifically disclosed, other embodiments falling within the scope of the claims will be apparent from the instant disclosure, which shows and describes illustrative embodiments of the invention. In different terms, the drawings and embodiments specifically shown and described are to be regarded as illustrative in nature and not restrictive with regard to the scope of the claims.

Figure 2:
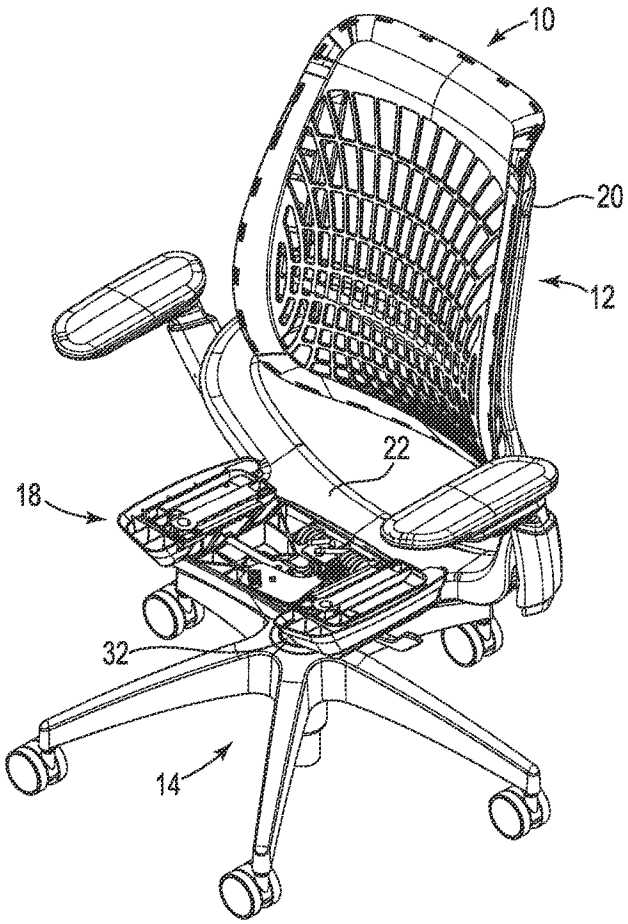
FIG. 2 shows the chair with a seat assembly of the chair removed, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 1:
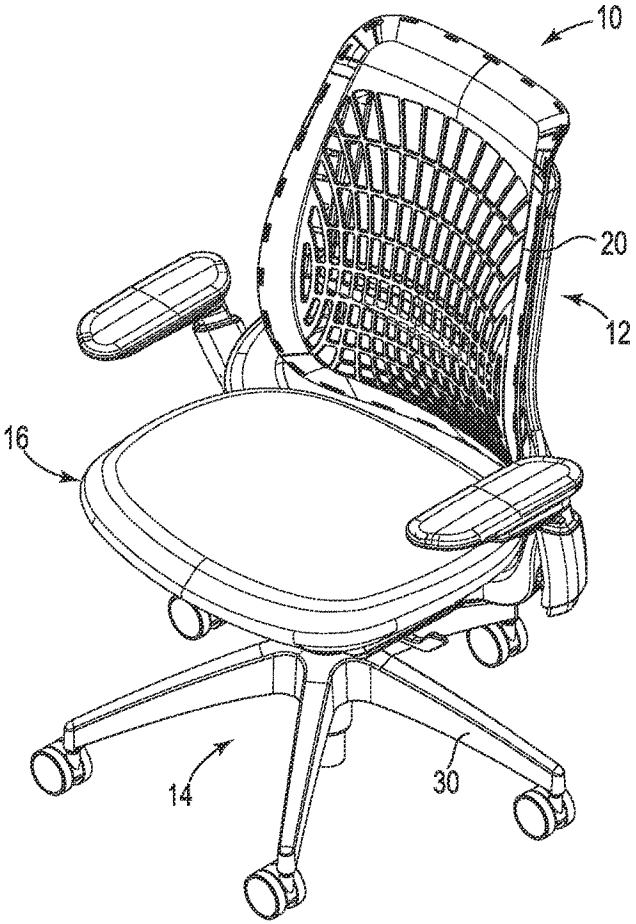
FIG. 1 shows a chair from an isometric view, according to some embodiments.

FIG. 1 shows a chair 10 from an isometric view, according to some embodiments. FIG. 2 shows the chair with a seat assembly of the chair removed, according to some embodiments. As shown, the chair 10 includes a back assembly 12, a base assembly 14, a seat assembly 16, and a control assembly 18. The back assembly 12 includes an upper portion 20 and a lower portion 22, the lower portion 22 being adapted to be secured to the control assembly 18. As shown, the base assembly 14 includes a lower portion 30 configured to rest on a surface, such as a floor (not shown), to support he chair 10 in use, as well as an upper portion 32 configured to be secured to the control assembly 18. As shown, the lower portion 30 is configured as a pedestal and the upper portion 32 as a cylinder, although a variety of base assembly configurations are contemplated.

As described in greater detail, the control assembly 18 is configured to transition the seating assembly from a lowered position to a raised position as the back assembly 12 transitions between an upright state, or upright position to a reclined state, or reclined position. In particular, in some embodiments the chair 10 is configured such that when the back assembly 12 is in a first upright state the control assembly 18 is in a first lowered state and when the back assembly 12 is in a reclined state the control assembly is in a second raised state. In some embodiments, the control assembly 18 is configured to raise a front portion of the seat assembly 16 more quickly and/or to a greater extent than a rear portion of the seat assembly 16 such that raised position includes the seat assembly 16 being tilted and moved upwardly and rearwardly.

Figure 3:
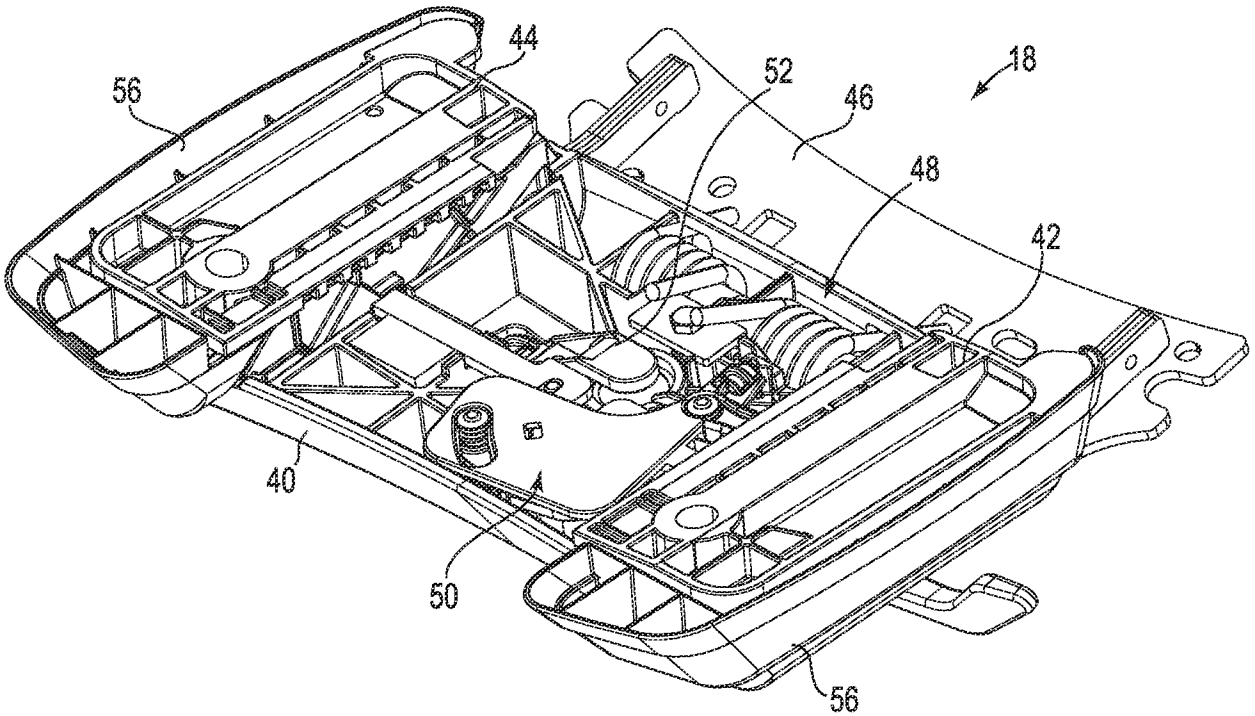
FIG. 3 shows the control assembly of the chair from an isometric view, according to some embodiments.
Figure 4:
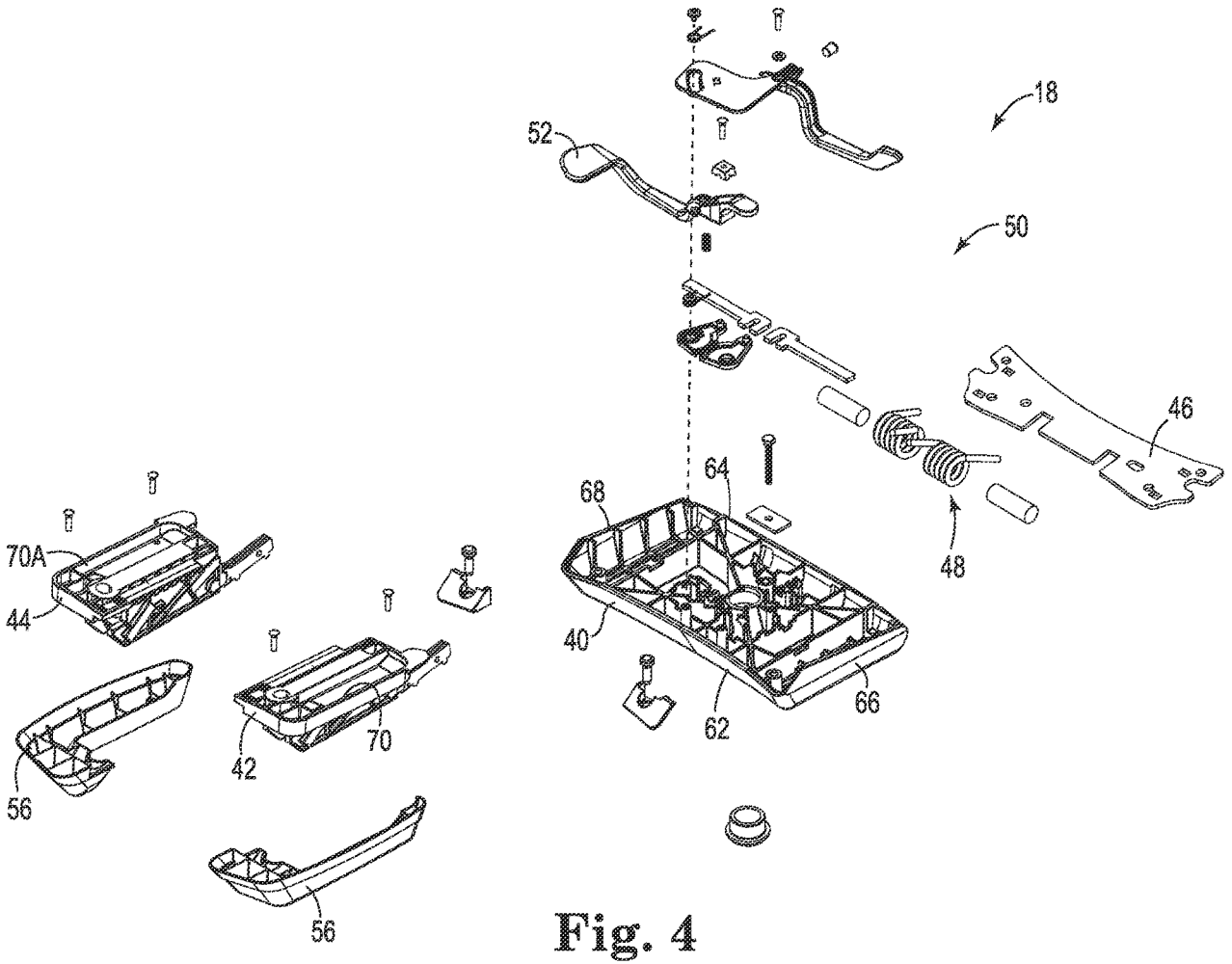
FIG. 4 shows the control assembly of the chair in a disassembled state, according to some embodiments.

FIG. 3 shows the control assembly 18 of the chair 10 from an isometric view and FIG. 4 shows the control assembly 18 in a disassembled state, according to some embodiments. As shown in FIGS. 3 and 4, the control assembly 18 includes a hub 40, a first cartridge 42, a second cartridge 44, a back mount 46, a torsion assembly 48, a tilt lock assembly 50, and a height lever 52. In general terms, the control assembly 18 is coupled to the back assembly 12, the base assembly 16, and the seat assembly 18. The control assembly 18 also includes covers 56. As shown and according to some embodiments, the control assembly 18 is generally a central component that interconnects the back assembly 12, the base assembly 16, and the seat assembly 18.

As shown in FIG. 4, the hub 40 includes a central opening 60, defines a front 62, a back 64, a first side 66, and a second side 68 and includes a variety of mounting features for securing various components of the control assembly 18 with fasteners such as bolts. As with all the various components of the chair 10, the hub 40 is formed of desired materials, such as polymeric or metallic materials for example.

Figure 5:
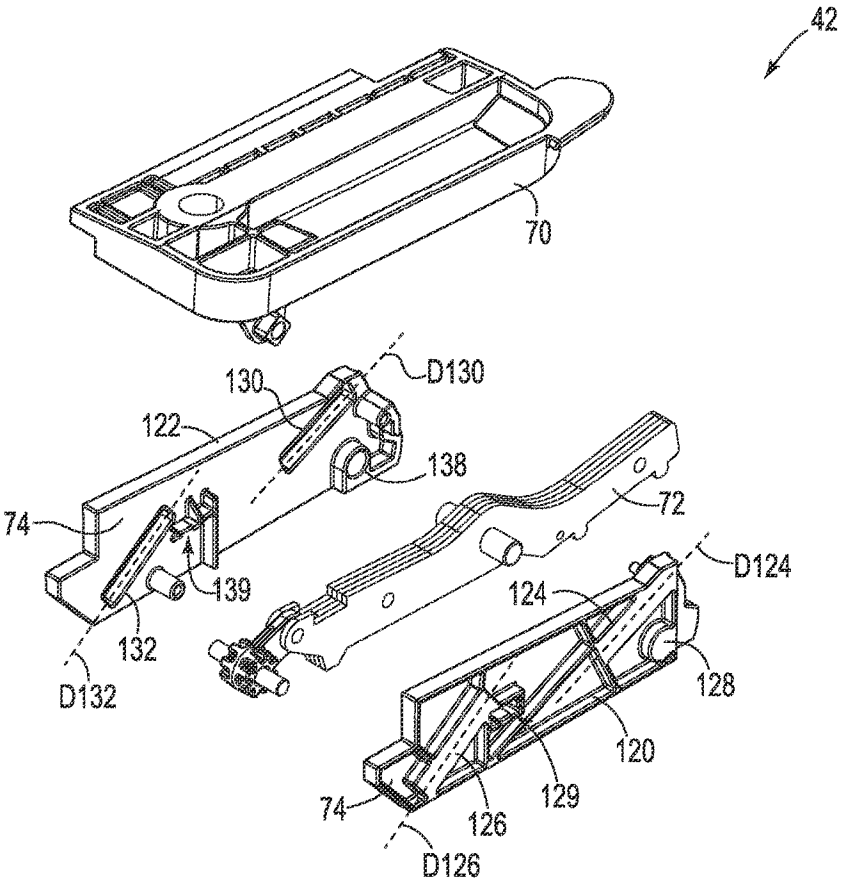
FIG. 5 shows a first chair control cartridge of the control assembly in a disassembled state, according to some embodiments.

FIG. 5 shows the first cartridge 42 in a disassembled state, according to some embodiments. As shown, the first cartridge 42 includes a seat support 70, a link arm 72, and a control body 74. The second cartridge 44 is optionally similar to the first cartridge, e.g., with a support 70A of the second cartridge 44 being a mirror image of the first cartridge 42 as shown in FIG. 4. Thus, various features of the second cartridge 44 are not separately described, instead being described collectively with reference to the first cartridge 46. When specifically referenced, features of the second cartridge 44 and are designated by similar reference numbers to the first cartridge followed by an "A" when specifically referenced. Although similar cartridges 42, 44 are shown and described, it should be understood that differing cartridges are also contemplated.

Figure 8:
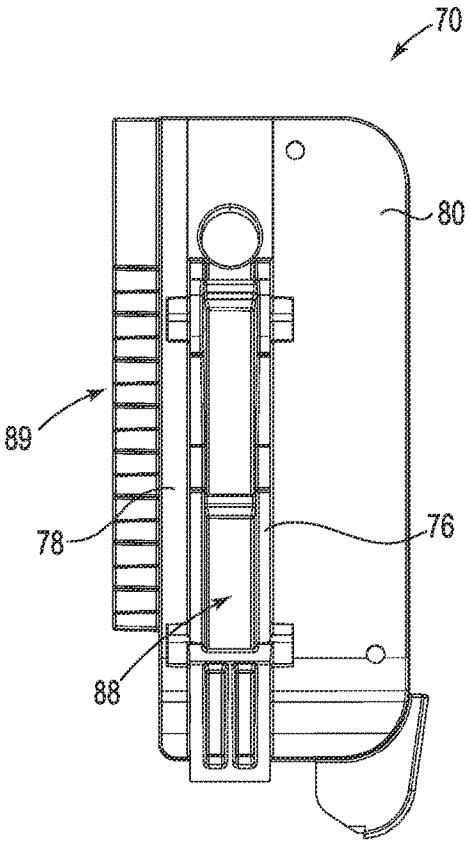
FIG. 8 shows the seat support from a bottom view, according to some embodiments.
Figure 6:
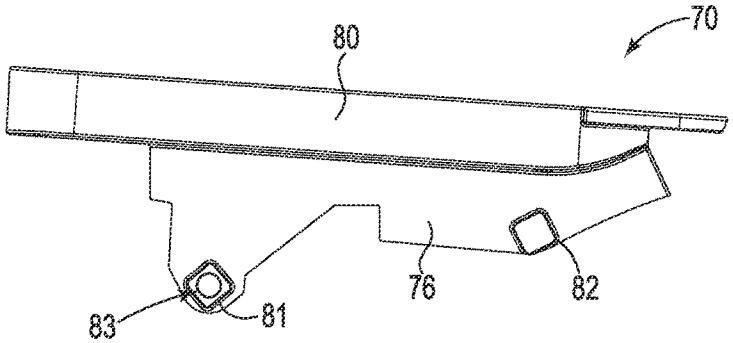
FIG. 6 shows a seat support of the chair from a first side view and FIG. 7 shows the seat support from an opposite, second side view, according to some embodiments.
Figure 7:
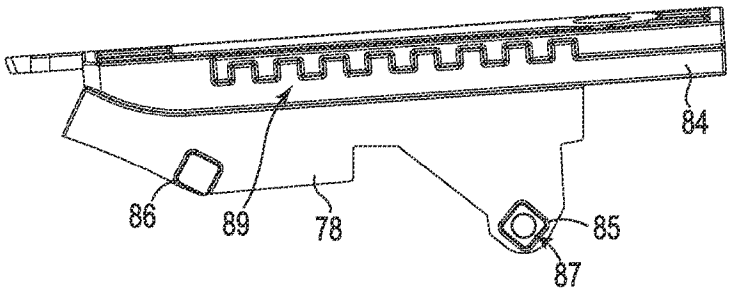

FIG. 6 shows the seat support 70 from a first side view and FIG. 7 shows the seat support 70 from an opposite, second side view, according to some embodiments. FIG. 8 shows, the seat support 70 from a bottom view, according to some embodiments. As shown, the seat support 70 includes a first flange 76, a second flange 78 spaced from the first flange 76, and a seat mount 80. The first flange 76 includes a front rider 81 and a back rider 82 and has a pivot aperture 83. The second flange 78 includes a front rider 85 and a back rider 86 and has a pivot aperture 87. The front riders 81, 85 are generally positioned opposite one another at a forward position on the seat support 70 and the back riders 82, 86 are positioned at a rearward position on the seat support 70. The first and second flanges 76, 78 define a gap 88, also described as a channel, for receiving the link arm 72 (FIG. 5). As shown, the seat mount 80 includes a plurality of notches 89, or recesses, that assist in providing a seat adjustment feature, as subsequently described in greater detail.

As shown, the pivot apertures 83, 87 are coaxial with the front riders 81, 85, although the pivot apertures can also be located elsewhere. Additionally, as shown, the front and/or back riders 81, 85, 82, 86 are formed as monolithic projections with square transverse cross-sections with rounded corners. In some embodiments, one or more of the riders 81, 82, 85, 86 is formed as a two part component including a post having a round transverse cross-section and a sleeve having a square transverse cross-section with rounded corners, the sleeve being rotatably or non-rotatably received over the post.

Figure 9:
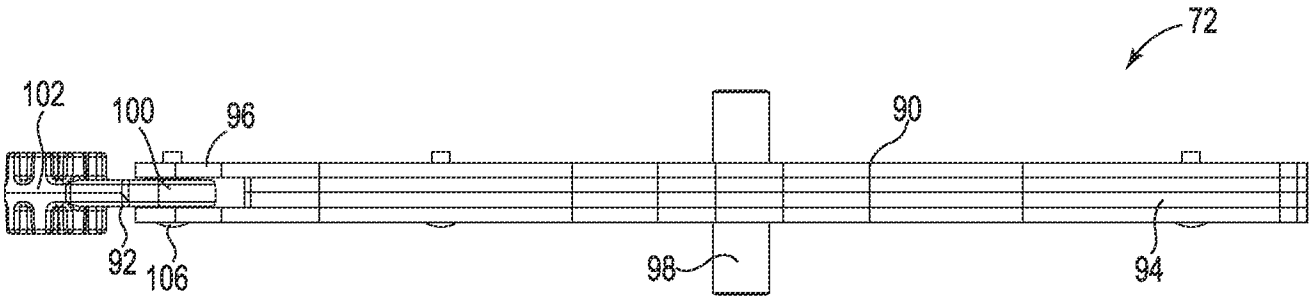
FIG. 9 shows a link arm of the chair control cartridge from a top view, according to some embodiments.
Figure 10:
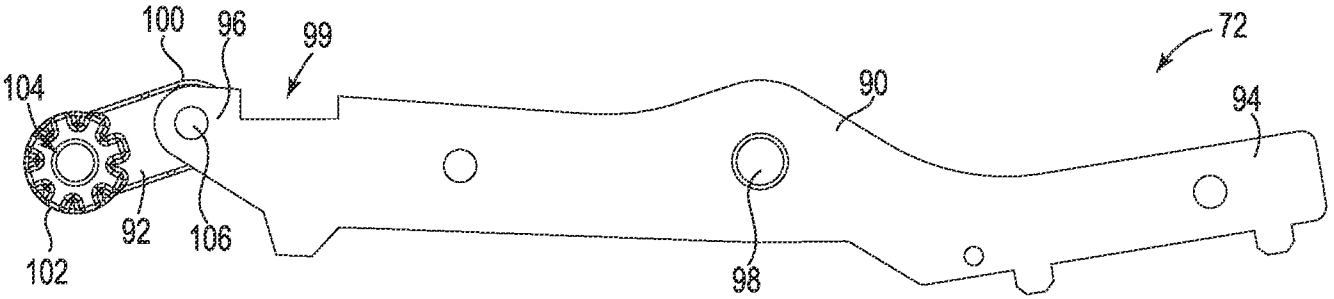
FIG. 10 shows the link arm of the chair control cartridge from a side view, according to some embodiments.

FIG. 9 is a top view of the link arm 72 and FIG. 10 is a side view of the link arm 72, according to some embodiments. As shown, the link arm 72 includes a body 90 and a pivot link 92. The body 90 has a first end 94 and a second end 96 and an intermediate pivot pin 98 located at an intermediate position between the first and second ends 94, 96. The body 90 also includes a locking recess 99 formed into the top of the body 90 toward the second end 96. As shown, the pivot link 92 includes a first end 100 that is pivotably connected to the second end 96 of the body 90. The pivot link 92 also includes a second end 102 having an aperture 104 for pivotably connecting the pivot link 92 to the seat support 70. As shown, the link arm 72 includes a link pivot pin 106 for pivotably securing the pivot link 92 to the body 90.

Figure 11:
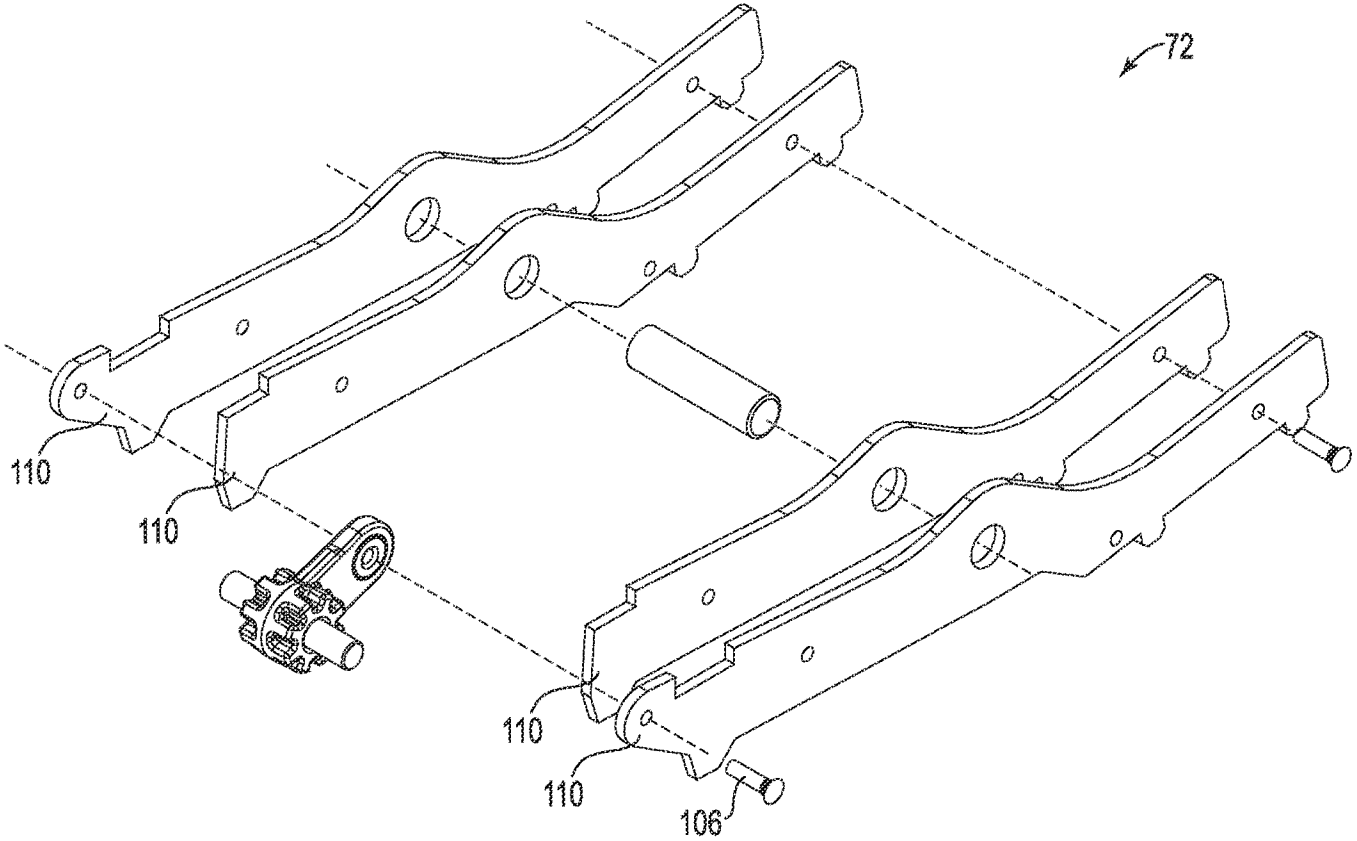
FIG. 11 shows the link arm of the chair control cartridge in a disassembled state, according to some embodiments.

FIG. 11 shows the link arm 72 in a disassembled state. As shown, the link arm 72 includes a plurality of plate members 110, or laminate members, secured together with the link arm 72 centrally interposed between the plate members 110 and pivotably connected thereto by the front pivot pin 106.

Returning to FIG. 5, the control body 74 of the first cartridge 42 includes a first wall 120, or side portion, and a second wall 122, or side portion. As shown, the first wall 120 includes a first, rear channel 124, or slot and a second, front channel 126, or slot. The rear channel 124 extends in a first direction D124 and the front channel 126 extends in a second direction D126. The first wall 120 also includes a pivot recess 128, or hub for receiving the intermediate pivot pin 98 of the link arm 72. As shown, the first wall 120 also includes mating features for aligning and/or securing the first wall 120 to the second wall 122. The first wall 120 also has a locking aperture 129 to facilitate a tilt locking feature, as subsequently described.

The second wall 122 is shown including a first, rear channel 130, or slot corresponding to the rear channel 124 of the first wall 120 and a second, front channel 132, or slot corresponding to the front channel 126 of the first wall 120. The rear channel 130 extends in a first direction D130 (parallel to and laterally offset from first direction D124) and the front channel 132 extends in a second direction D132 (parallel to and laterally offset from second direction D126). The second wall 122 also includes a pivot recess 138, or receiver that corresponds to the pivot recess 128 for receiving the intermediate pivot pin 98 of the link arm 72. The second wall 122 includes complementary mating features for aligning and/or securing the first wall 120 to the second wall 122. The second wall 120 also has a locking aperture 139 to facilitate a tilt locking feature, as subsequently described.

Assembly of the first cartridge 42 includes receiving the link arm 72 in the gap 88 formed between the first and second flanges 76, 78 of the seat support 70. The front pivot pin 140 is received through the pivot apertures 83, 87 that extend through the front riders 81, 85. The first and second walls 120, 122 are positioned opposite one another about the link arm 72, as well as the flanges 80, 82 of the seat support 70. Upon assembly, the intermediate pivot pin 98 is received in the pivot recesses 128, 138 and the front riders 81, 85 are slidably and/or rotatably received in the front channels 126, 132 and the rear riders 82, 86 are slidably and/or rotatably received in the rear channels 124, 130. The link arm 72 is thereby pivotably secured to the control body 74 at an intermediate position on the link arm body 90 and the link arm pivot link 92 is pivotably secured to the seat support 70.

Figure 12:
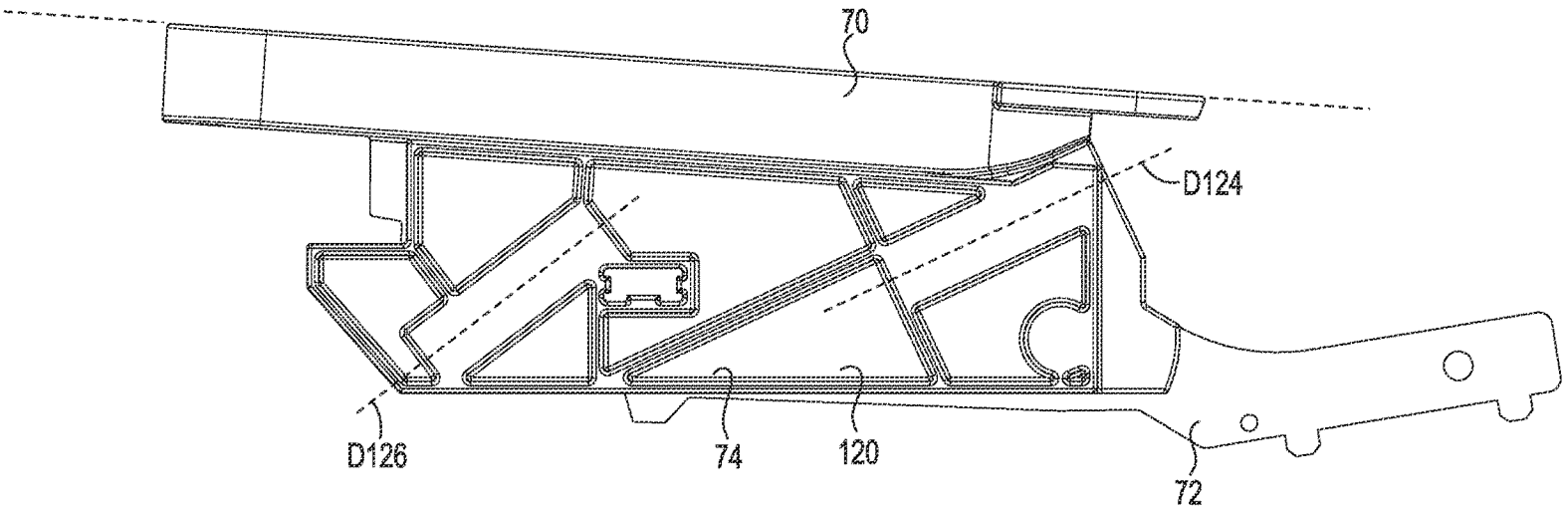
FIG. 12 shows the chair control cartridge from a side view in a first, lowered state and with some portions partially see-through to assist in understanding, according to some embodiments.
Figure 13:
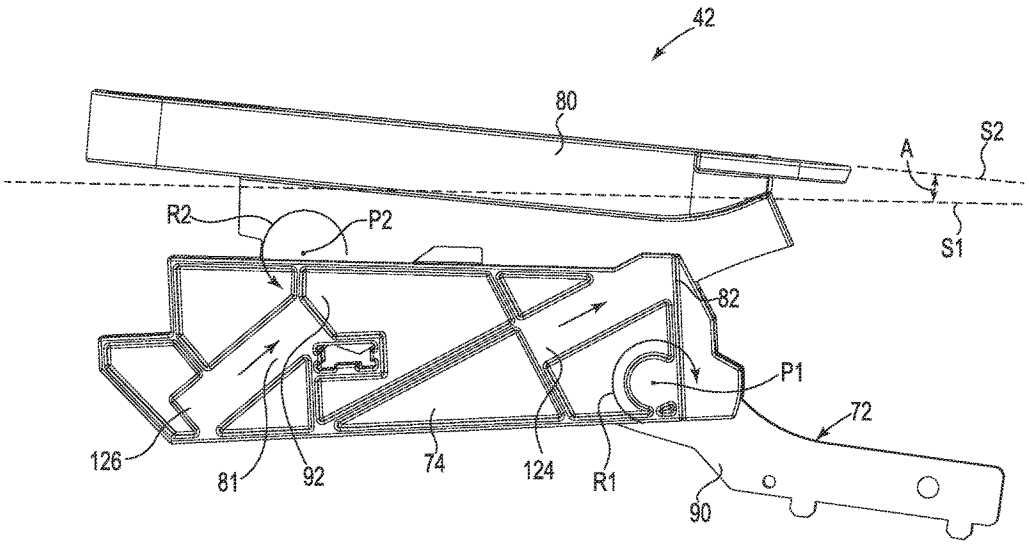
FIG. 13 shows the chair control cartridge from a side view in a second, raised state and with some portions partially see-through to assist in understanding, according to some embodiments.

FIG. 12 is side view of the first cartridge 42 with the first cartridge in a lowered state and FIG. 13 is a side view of the first cartridge 42 in a raised state, according to some embodiments. For ease of understanding, portions of the first wall 120 of the control body 74 and the seat support 70 are shown partially see through in FIGS. 12 and 13, such that the position and movement of the various components in operation, including the seat support 70 and the link arm 72 is more visible.

As indicated in FIG. 13, the body 90 of the link arm 72 is rotated in a first direction R1 about a first pivot P1 which causes the pivot link 92 to rotate in a second direction R2 that is opposite to the first direction R1 about a second pivot P2. This rotation causes the front riders 81, 85 and the rear riders 82, 86 of the seat support 70 to move upwardly and rearwardly in the front channels 126, 132 and the rear channels 124, 130, respectively, of the control body 74. As shown, the motion of the riders in the channels causes the seat mount 80 of the seat support 70 to move from a first lowed support position S1 to a second raised support position S2. As indicated, the front of the seat mount 80 is raised to a relatively greater extent than the rear of the seat mount 80. In different terms, there is both a tilting motion, with the front of the seat support being tilted at an angle "A" and an upward and rearward motion of the seat mount 80 upon rotation of the body 90 of the link arm 72 in the first direction R1.

In some embodiments, the raising and tilting action is adjusted by selecting the directions of the front channels D126, D132 and the rear channels D124, D130 and the relative angular offsets of those channels. In some embodiments, the rear sets of channels 124, 130 extend in parallel direction to the front set of channels 126, 132 such that only a raising and lowering motion (e.g., in an upward and rearward direction) is accomplished. In other embodiments, and as shown, the directions D126, D132 in which both the front channels extend is angularly offset from the direction D124, D130 in which both the rear channels extend to accomplish the described tilting action. In particular, and as shown, the front channels rise at a relatively steeper angle than the rear channels to accomplish rearward tilting, although the opposition angular offset (a relatively shallower front angle) can also be employed to achieve a forward tilting action.

In some embodiments, the chair 10 is configured such that when the chair is supported on a horizontal surface, the front channels 126, 132 extend along directions D126, D132 at an angle of about 37 degrees relative to horizontal, or from about 20 degrees to about 60 degrees, for example, although a variety of angles are contemplated, and the rear channels 124, 130 extend along directions D124, 130 at an angle of about 25 degrees relative to horizontal, or from about 10 degrees to about 40 degrees, for example, although a variety of angles are contemplated. In some embodiments, the front channels 126, 132 are angularly offset from the rear channels 124, 130 by an absolute angle of about 12 degrees (in the counterclockwise direction as shown in FIG. 13), or from about 0 degrees to about 25 degrees, for example, although a variety of angles are contemplated.

In some embodiments, the body 90 of the link arm 72 is secured to the lower portion 22 of the back assembly 12 with the back mount 46 and the seat assembly 18 is secured to the seat mount 80 of the seat support 70. The second control cartridge 44 is similarly secured to the back assembly 12 and the seat assembly 18 such that rearward tiling, or reclining, of the back assembly 12 causes the control assembly 18 to transition from the lowered state (FIG. 17) to the raised state (FIG. 19), thereby resulting in raising the seat assembly in an upward and rearward direction and also tilting of the seat assembly 18 in a rearward, or counterclockwise direction (from a right side view).

Figure 14:
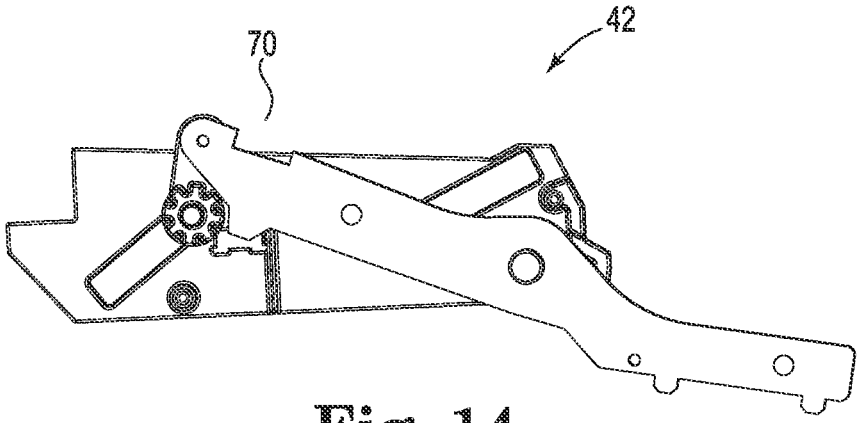
FIGS. 14 to 16 show the link arm and a control body of the chair control cartridge in various states of actuation and with some portions partially see-through to assist in understanding, according to some embodiments.
Figure 15:
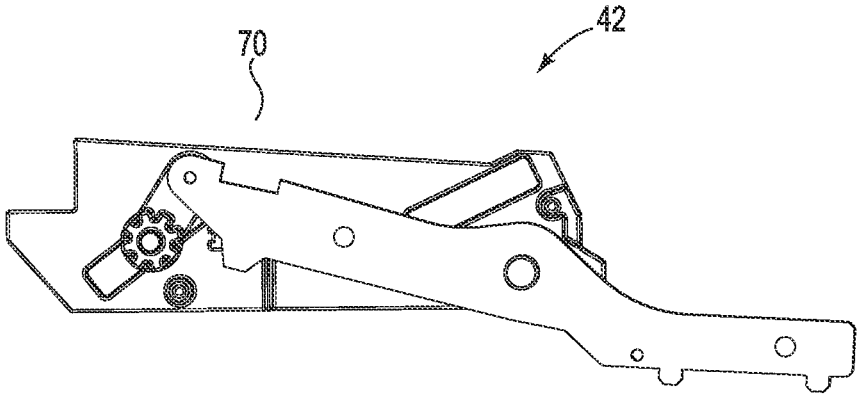
Figure 16:
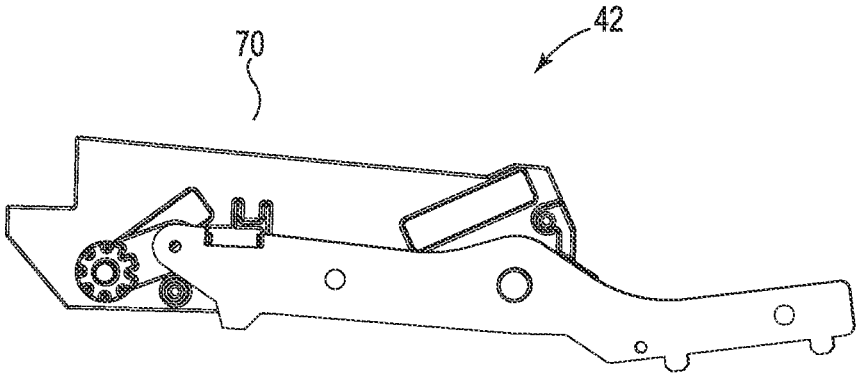

FIGS. 14 to 16 show progressive movement of the first control cartridge 42 from the lowered state (FIG. 14) to the fully raised state (FIG. 16).

Figure 17:
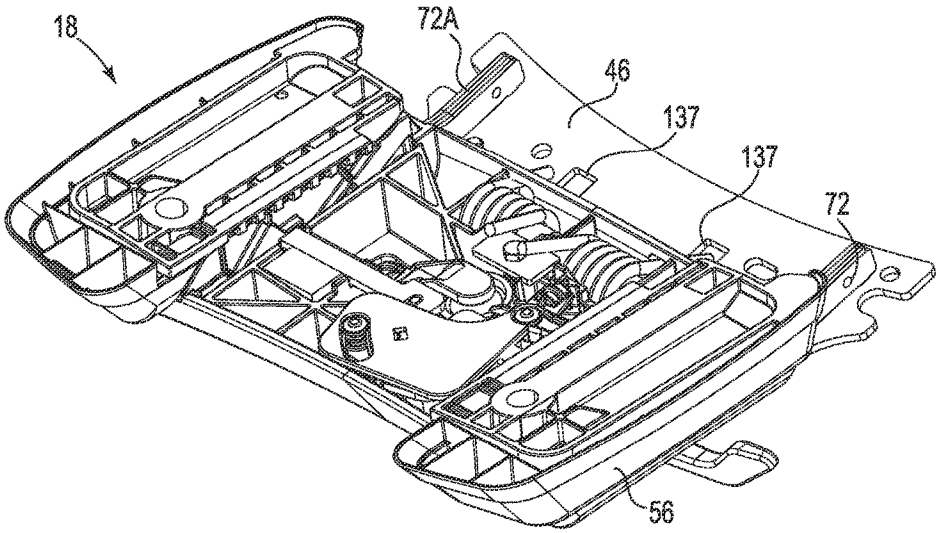
FIG. 17 shows a control assembly of the chair in the first lowered state from an isometric view, according to some embodiments.

FIG. 17 shows the back mount assembled to the rear portions of the link arms 72, 72A. As shown, the back mount 46 is configured to extend between the cartridges and includes recesses 137 (see also FIG. 22) for receiving a portion of the torsion assembly 48.

Figure 18:
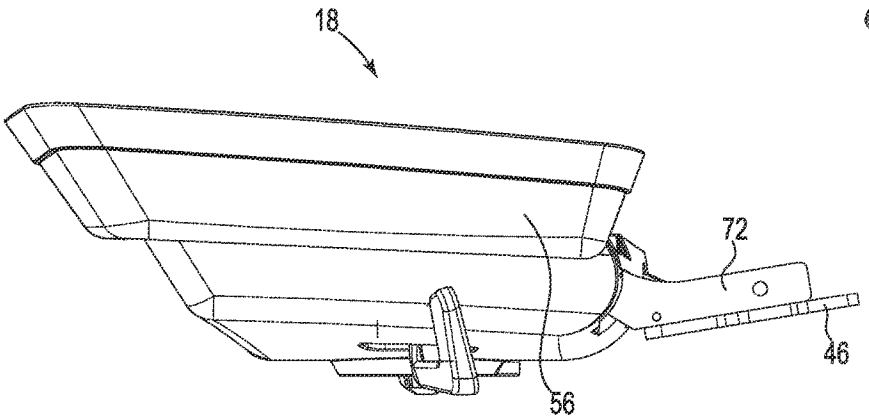
FIG. 18 shows the control assembly of the chair in the first lowered state from a side view, according to some embodiments.
Figure 19:
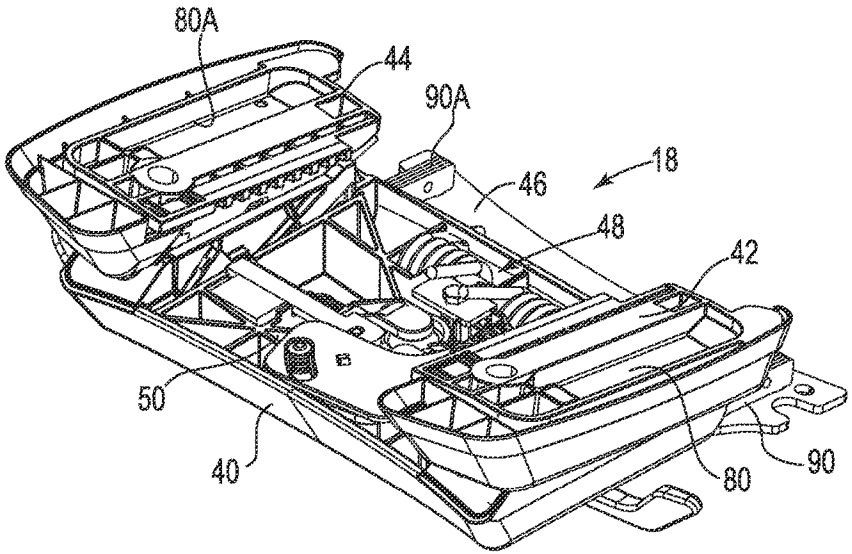
FIG. 19 shows the control assembly of the chair in the second, raised state from an isometric view, according to some embodiments.
Figure 20:
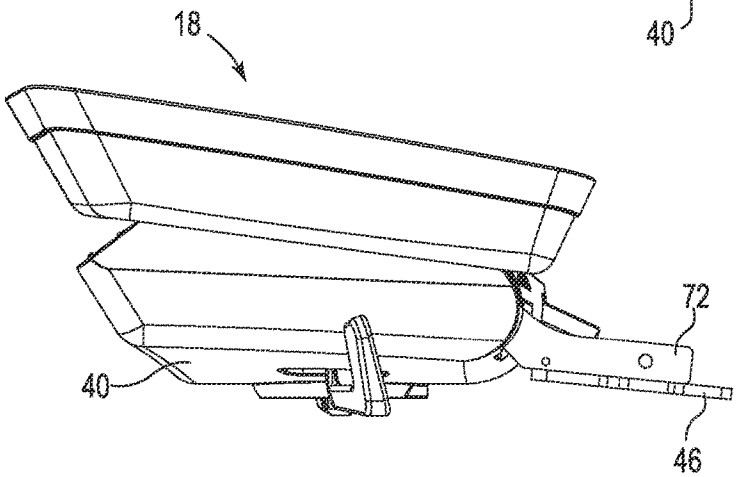
FIG. 20 shows the control assembly of the chair in the second, raised state from a side view, according to some embodiments.

FIGS. 17 and 18 show the control assembly 18 in an assembled state, with the control assembly 18 in the lowered state. FIGS. 19 and 20 show the control assembly 18 in an assembled state with the control assembly 18 in the raised state. As shown, the back mount 46 of the control assembly 18 is secured to the second ends of the bodies 90, 90A of the link arms 72, 72A. The first and second cartridges 42, 44 are maintained by the hub 40 on opposite sides of the hub 40. The tilt lock assembly 50 is positioned between the cartridges 42, 44 and is also maintained by the hub 40. The torsion assembly 48 is positioned rearward of the tilt lock assembly 50. The torsion assembly 48 facilitates return of the chair back assembly 12 to the upright position, return of the control assembly 18 to the lowered state, and also provides a desired resistance to tilting of the chair back assembly 12, according to some embodiments.

Figure 22:
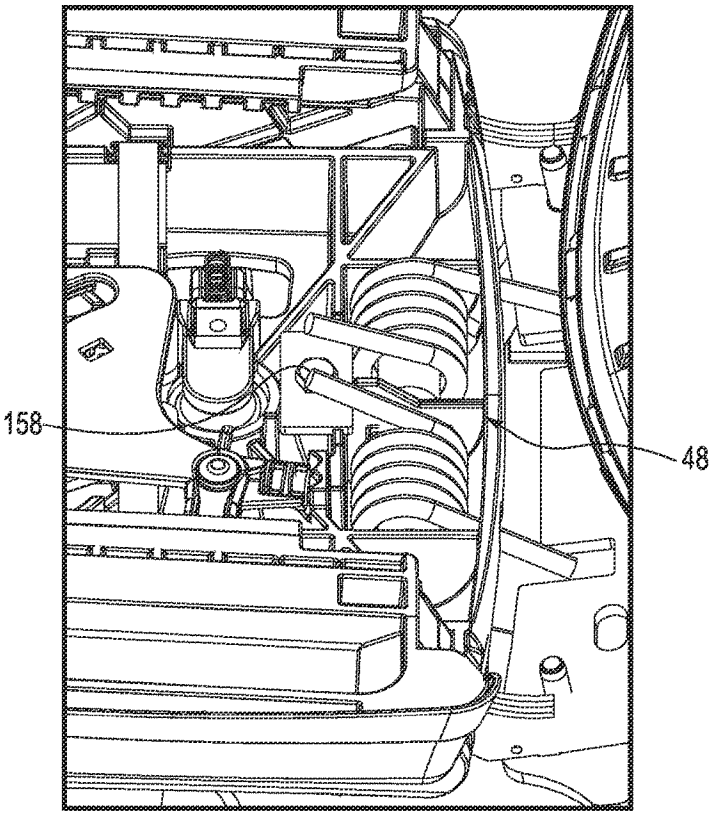
FIGS. 21 and 22 are isometric views of a portion of the chair showing the chair control assembly, according to some embodiments.
Figure 21:
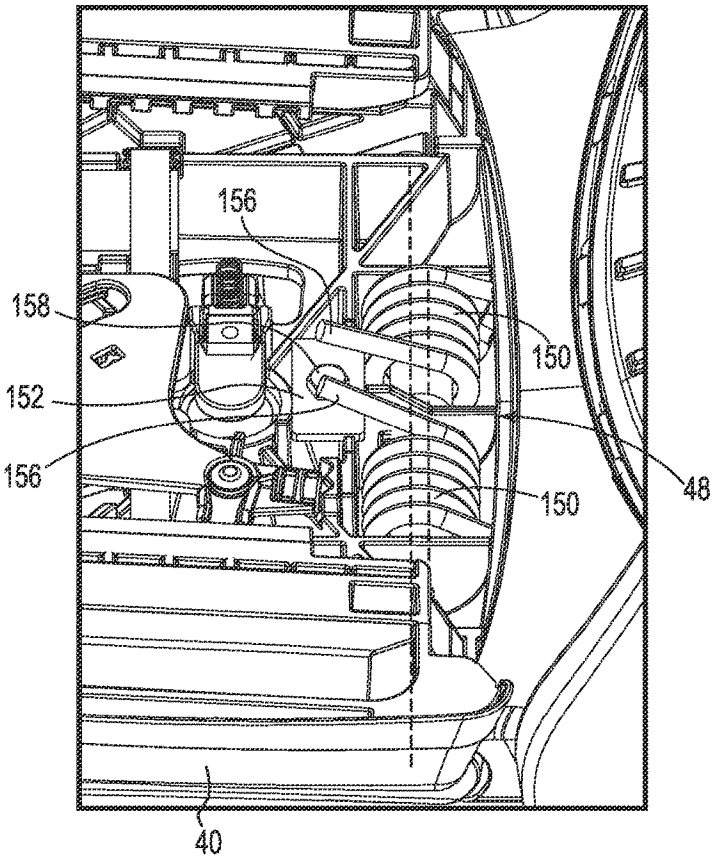
Figure 23:
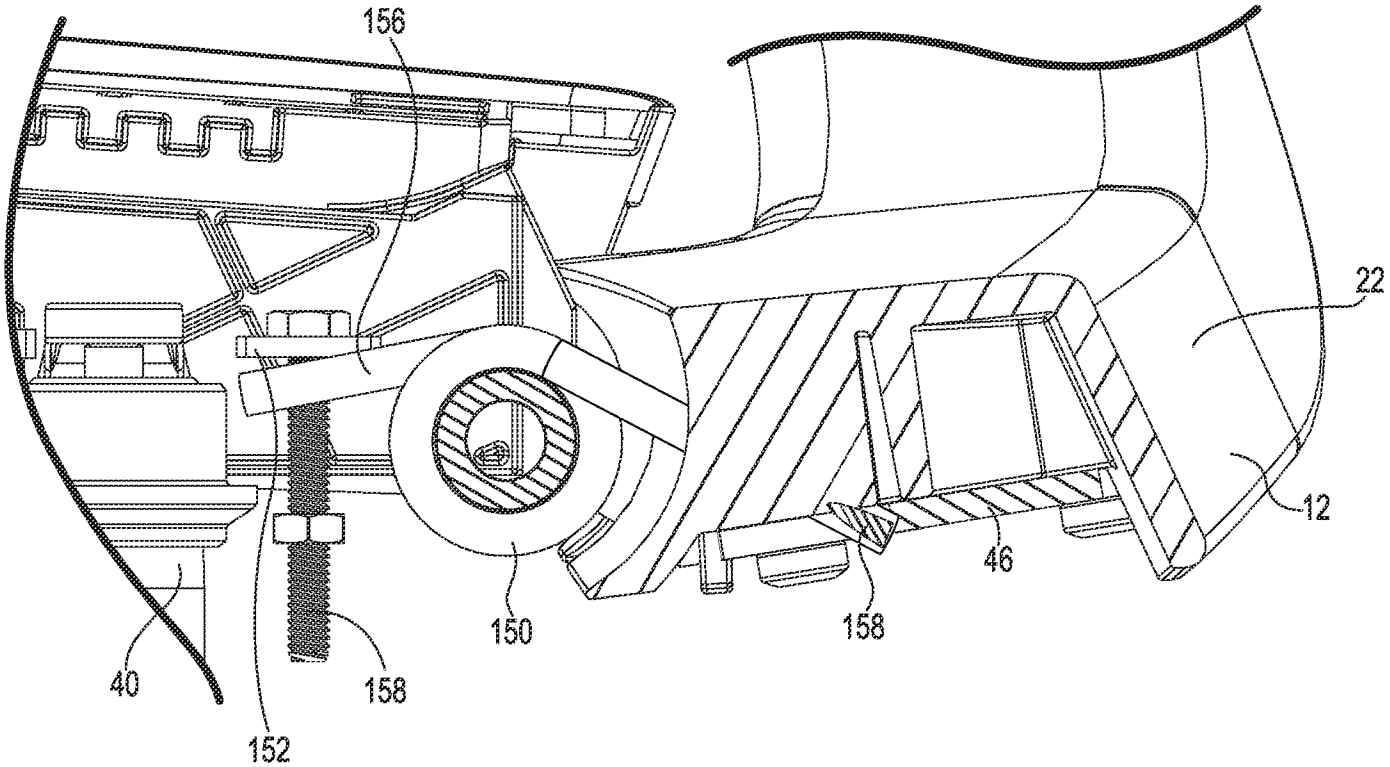
FIG. 23 is a side view of a portion of the chair showing the control assembly and the back assembly of the chair, according to some embodiments.
Figure 24:
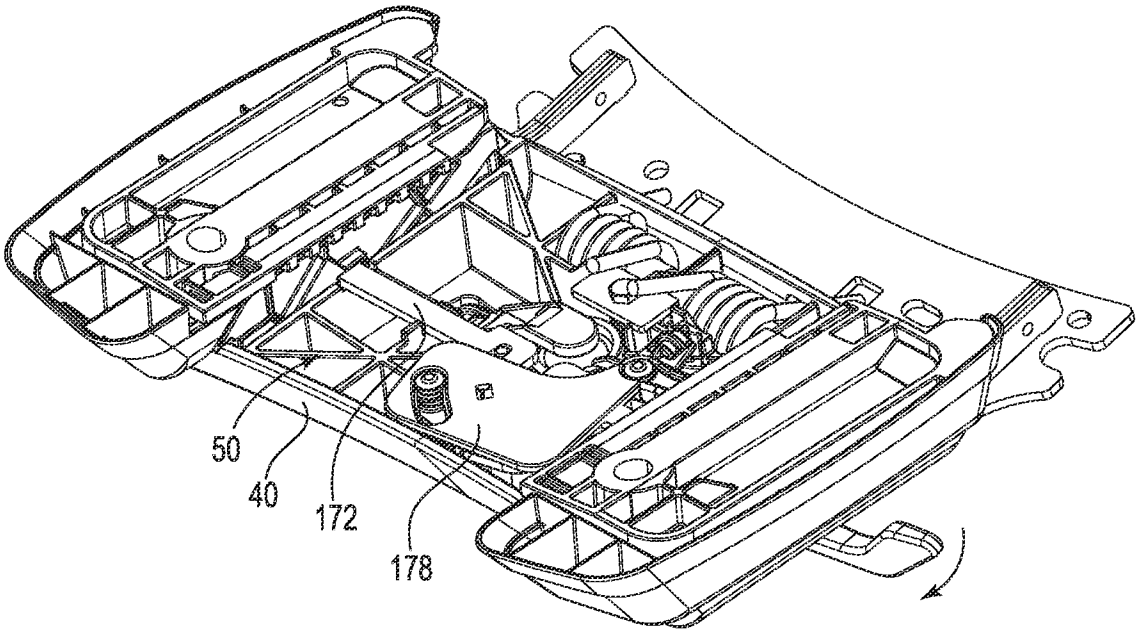
FIG. 24 shows the chair control assembly from an isometric view, according to some embodiments.
Figure 25:
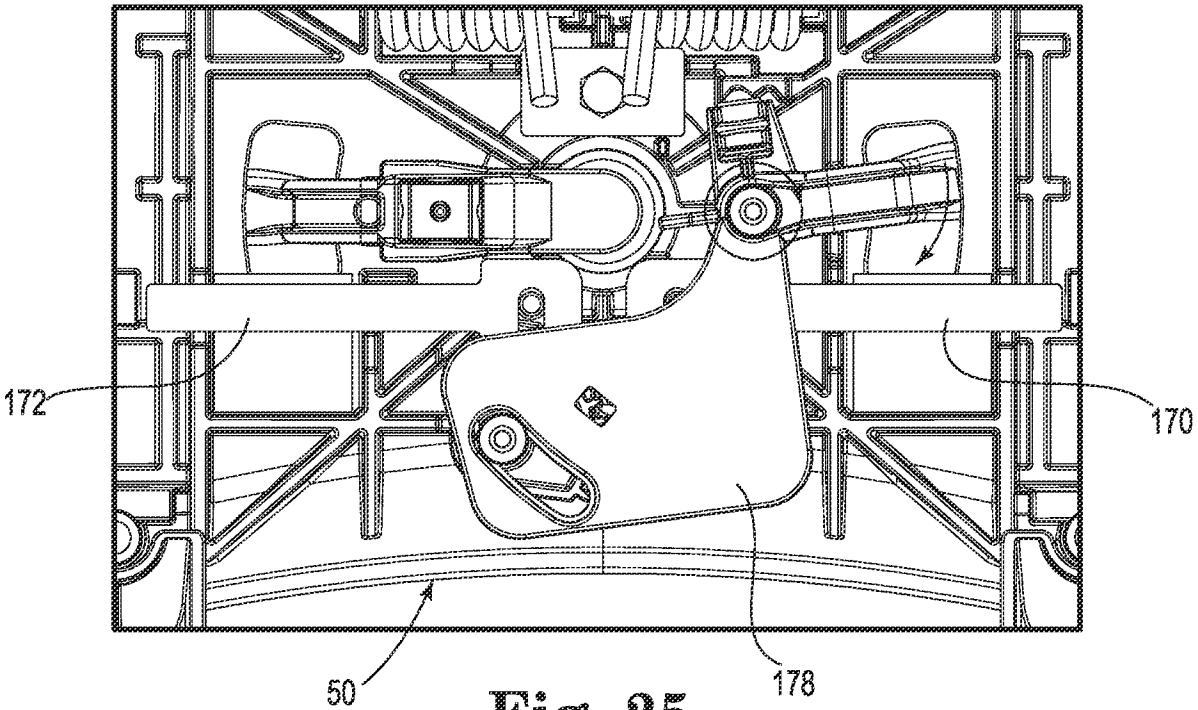
FIG. 25 is a top view of a portion of the chair control assembly, according to some embodiments.

FIGS. 21 and 22 are enlarged views showing the torsion assembly 48 in greater detail. As shown, the torsion assembly 48 includes torsion spring(s) 150, and an adjustment plate 152 secured to the hub 40. Although shown unsecured in FIGS. 3, 17, 21 and 22, first ends 156 of the torsion springs 150 are received under the adjustment plate 152 and an associated fastener 158, such as a bolt, is tightened or loosened to increase or decrease the spring tension, as shown more clearly in the side view of FIG. 23. Second ends 158 of the torsion springs 150 are received below the back mount 46 to provide the desired force/resistance against the back mount 46 and/or the back assembly 12.

Figure 26:
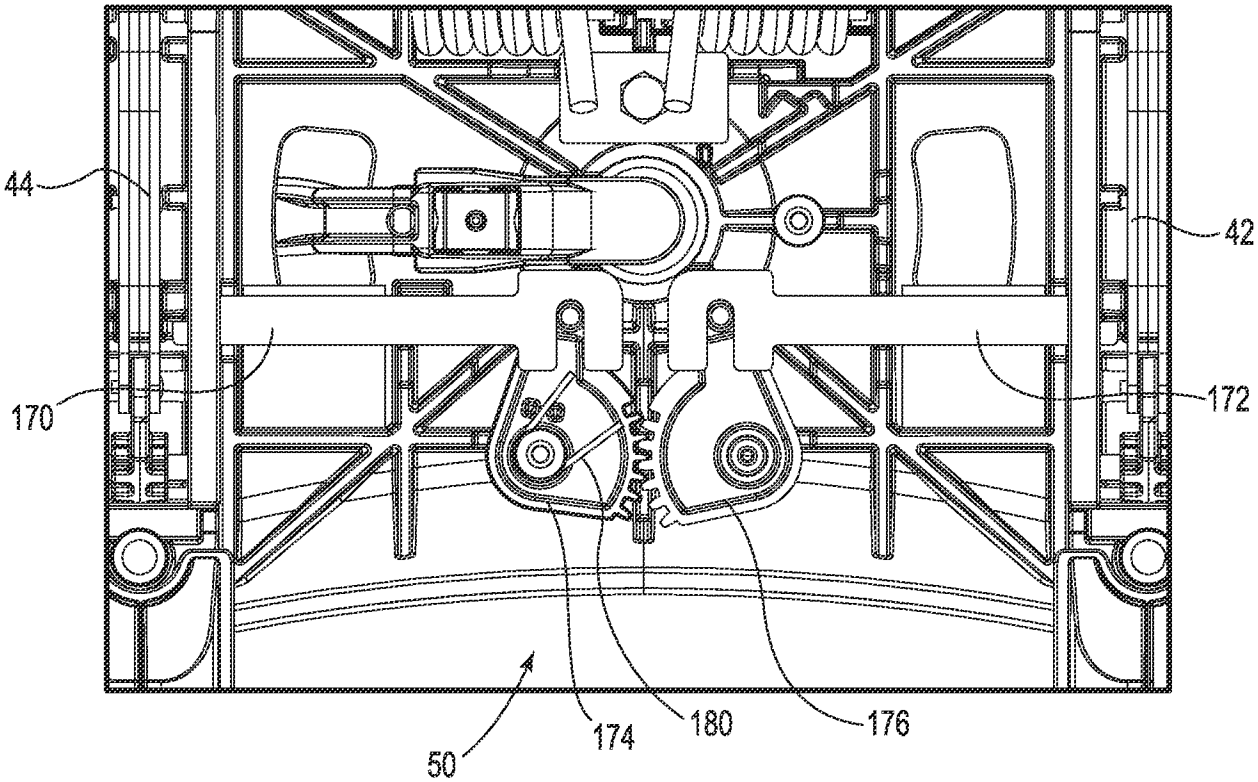
FIGS. 26 and 27 are top views of a portion of the chair control assembly with portions removed for understanding, according to some embodiments.
Figure 27:
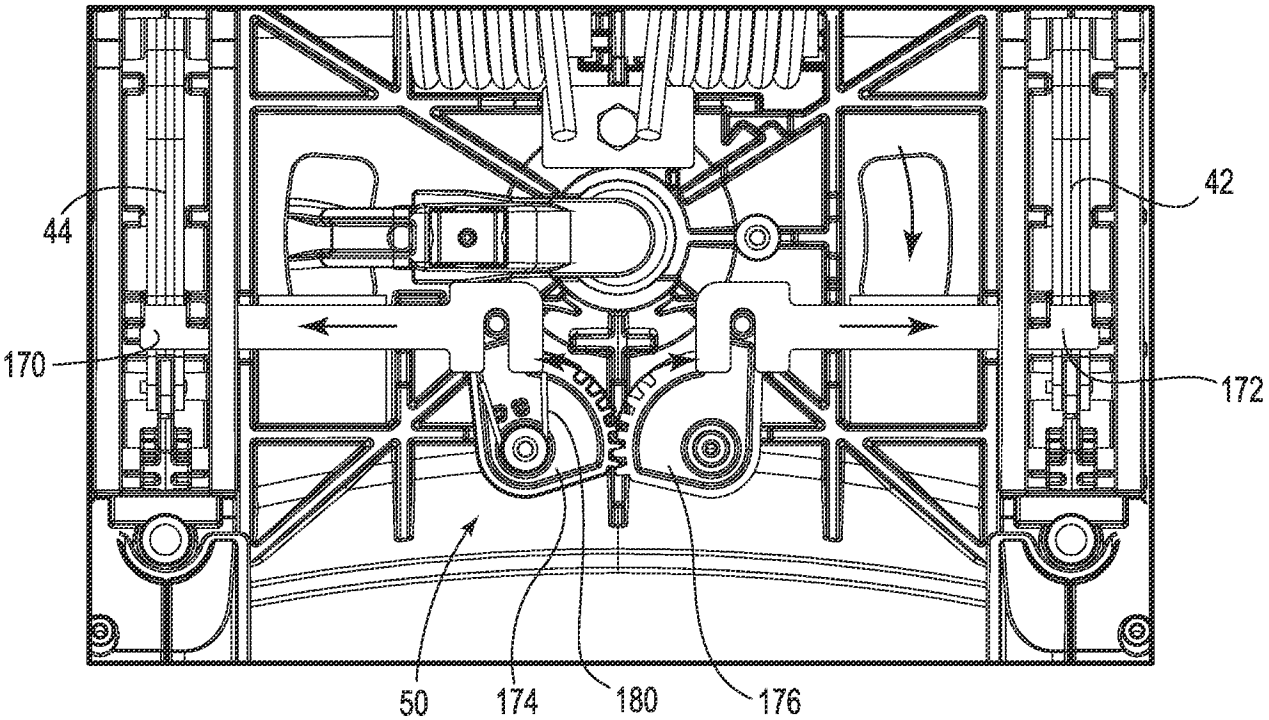

The tilt lock assembly 50 is shown in greater detail in FIGS. 24 to 27, according to some embodiments. As shown in the various figures, the tilt lock assembly 50 includes first and second tilt lock bars 170, 172, first and second lock gears 174, 176, tilt lock lever 178, and tilt lock spring 180. In FIGS. 26 and 27, the tilt lock lever 178 is not shown so the various components and locking operation are visible.

As shown, the tilt lock lever 178 is rotatably coupled to the hub 40, as are the lock gears 174, 176. The lock gears 174, 176 are intermeshed and in turn are coupled to the tilt lock bars 170, 172 such that rotation of the gears results in extension or retraction of the tilt lock bars 170, 172. The tilt lock lever 178 is engaged with the tilt lock spring 180, which in turn is coupled to the first lock gear 174. In use, the tilt lock lever is rotated in a first direction, engaging the tilt lock spring 180, which in turn causes the first gear 174 to rotate. As the first and second gears 174, 176 are intermeshed, such that rotation of the first gear 174 results in rotation of the second gear 176. Rotation of the first gear 174 results in extension of the first tilt lock bar 170 through the lock aperture 129A, the locking recess 99A, and the lock aperture 139A of the second cartridge 44, thereby locking the link arm 72A to the control body 74A with the first tilt lock bar 170. In this manner, the second cartridge is locked in the lowered state. The first cartridge 42 is similarly (and simultaneously) locked by the second tilt lock bar 172 as it is extended by the second gear 176. This operation locks the control assembly 18, which is secured to the chair back assembly 12, thereby locking the chair 10 against tilting of the chair back assembly 12. Upon rotation of the tilt lock lever 178 in the opposite direction, the tilt lock bars 170, 172 are released from the cartridges 42, 44, allowing the chair 10 to take on a reclined state.

By coupling the tilt lock lever 178 to the first gear 174 with the lock spring 180, a safety feature is optionally incorporated to help prevent inadvertent unlocking of the chair. In other words, if the chair back assembly 12 is being pushed rearwardly, an inadvertent pressure on the tilt lock lever 178 will be less likely to unlock the chair 10. Also, enhanced lock activation is also incorporated as the spring action provides a resilient force that helps the tilt lock bars 170, 172 locate and pass through the locking features in the cartridges 42, 44. Similarly, the tilt lock spring 180 acts as a clutch mechanism to allow a user to activate the lever 178 at any time during recline, where the tilt lock lever 178 remains in a locking position (e.g., by a detent or retaining means), and upon taking a sufficiently upright state (or non-reclined state), the tilt lock bars 170, 172 are activated to lock the chair 10 in the upright state.

Figure 28:
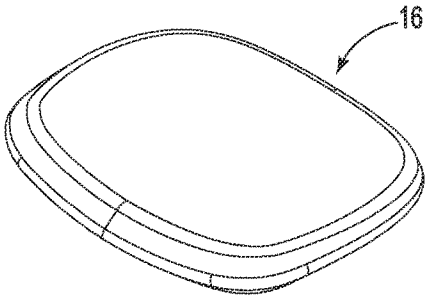
FIG. 28 shows the seat assembly of the chair from an isometric view, according to some embodiments.
Figure 29:
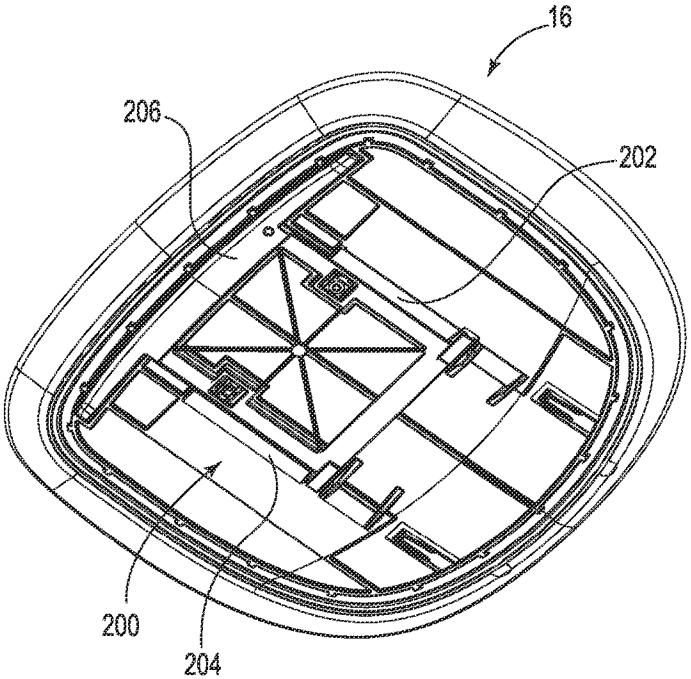
FIG. 29 shows the seat assembly of the chair from an isometric view according to a second point of view, according to some embodiments.

FIG. 28 shows the seat assembly 16 from a top-down oriented perspective view and FIG. 29 shows the seat assembly 16 from a bottom-up oriented perspective view. As shown, the seat assembly 16 includes an adjustable mount 200 on the bottom of the seat assembly 16, the adjustable mount including two opposing guide channels 202, 204 and a latch assembly 206 that mate with the seat supports 70, 70A (FIG. 17) of the first and second cartridges 42, 44.

Figure 30:
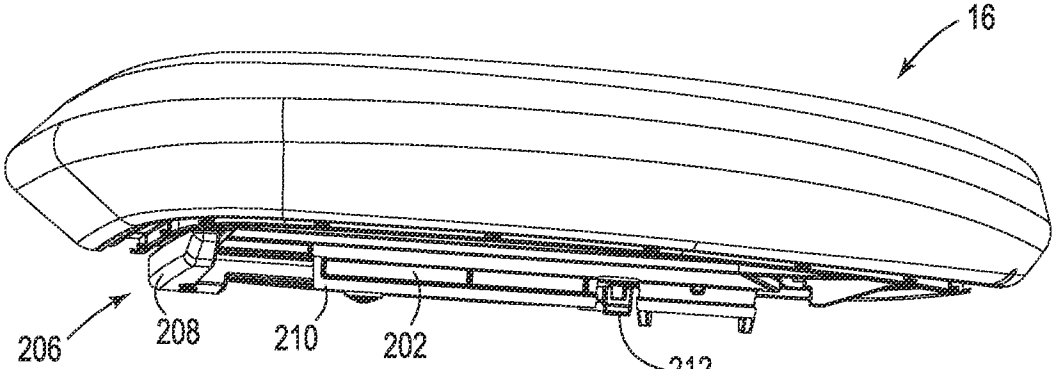
FIGS. 30 and 31 are side views of a seat assembly of the chair, according to some embodiments.
Figure 31:
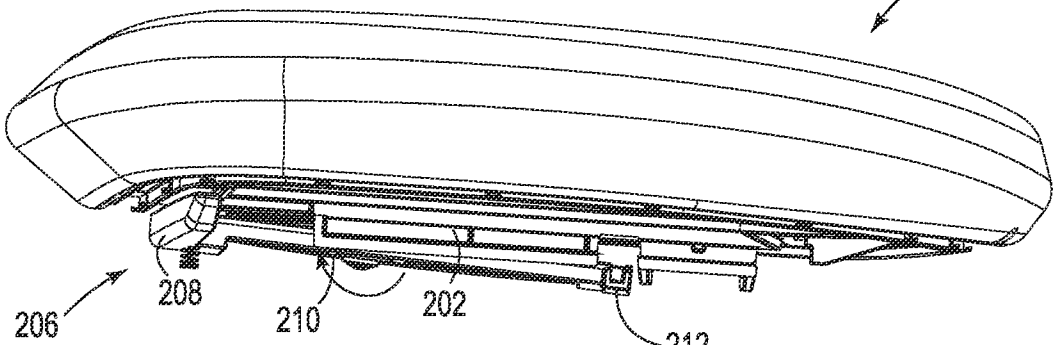

FIGS. 30 and 31 are side views of the seat assembly 16. As shown, the latch assembly 206 includes a front handle 208, an intermediate portion 210 that is pivotably coupled to a lower portion of seat assembly 16, and a rear clamp 212 that is configured to engage into the notches 89 of the seat support 70 (and 70A). As shown in FIG. 31, upon depression of the front handle 208, the rear clamp 212 is actuated downwardly.

Figure 32:
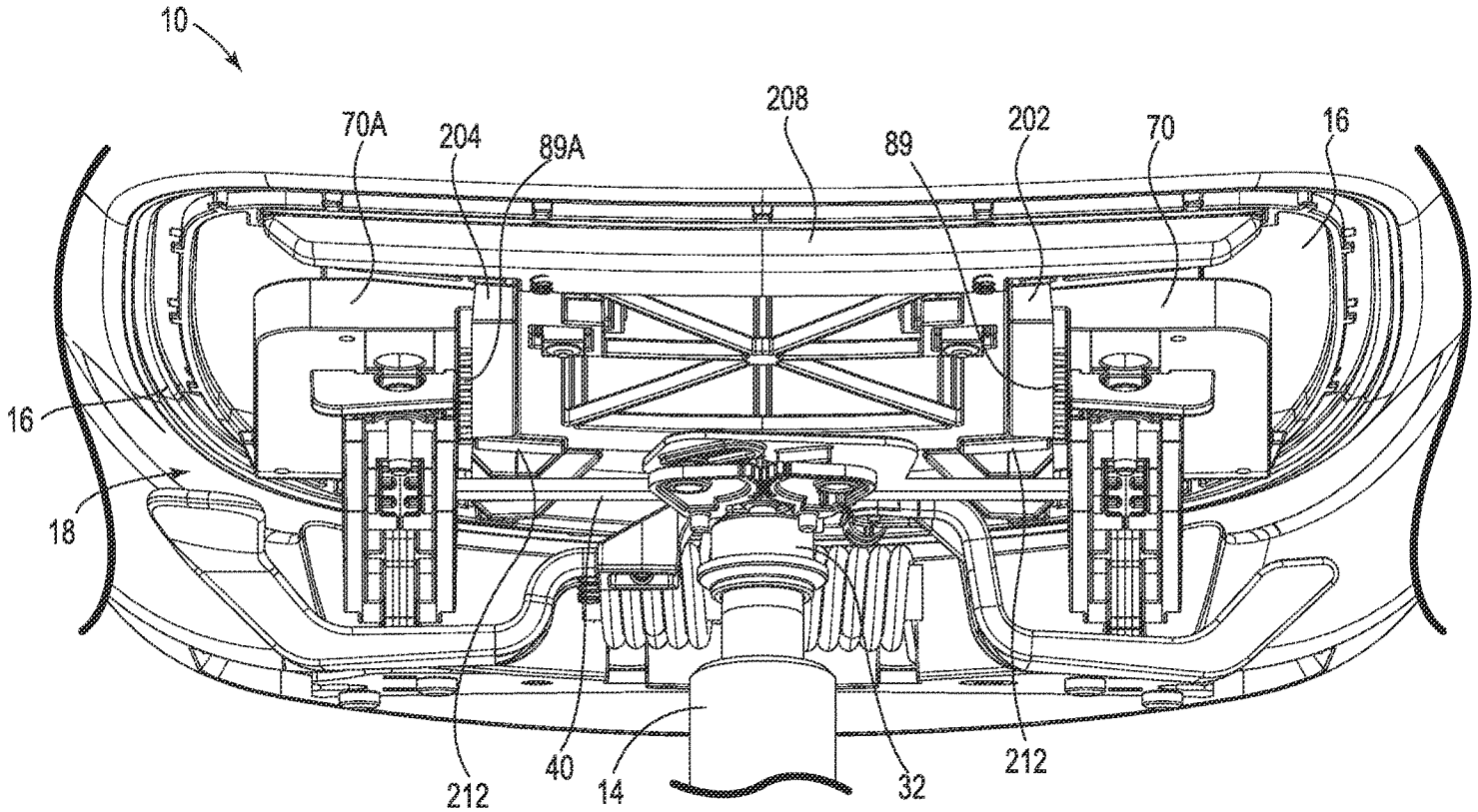
FIG. 32 is an isometric view of a portion of the chair, according to some embodiments.

FIG. 32 is an enlarged view of a portion of the chair 10, showing the seat assembly 16 and the control assembly 18. As shown, the guide channels 202, 204 are slidably received over the seat supports 70, 70A such that the seat assembly 16 is able to be slide forward (and backward) upon disengagement of the rear clamp 212 from the notches 89 of the seat support 70 and notches 89A of the seat support 70A.

As indicated previously, a method of assembling the chair 10 includes coupling the base assembly 14 to the control assembly 18. As shown in FIG. 32, the upper portion 32 of the base assembly 14 is configured as a cylinder that is received into the central opening 60 of the hub 40 and secured thereto. The seat assembly 16 is slidably secured to the control assembly 18 as previously described. The lower portion 22 (FIG. 23) of the back assembly 12 is secured to the back mount 46.

Figure 33:
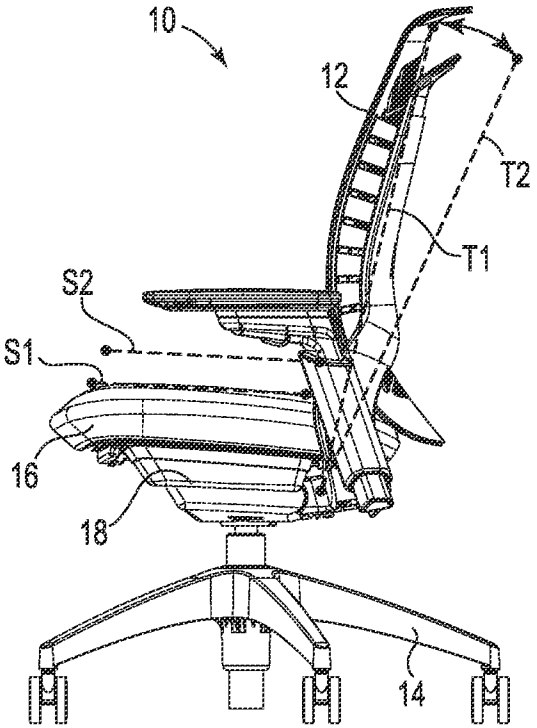
FIG. 33 shows the chair from a side view with the seat assembly in a fully retracted state, according to some embodiments.

FIG. 33 indicates a syncrotilt action of the chair 10, according to some embodiments. As shown, as the chair back assembly 12 transitions from a first, upright position T1 to a second, relatively tilted position T2, the seat assembly 16 transitions from a first lowered position S1 to a second raised position S2. As previously described, and as indicated in FIG. 33, the second raised position S2 of the seat assembly 16 includes the seat assembly 16 being moved upwardly and rearwardly relative to the first position S1, as well as tilted rearwardly relative to the first position S1.

Figure 34:
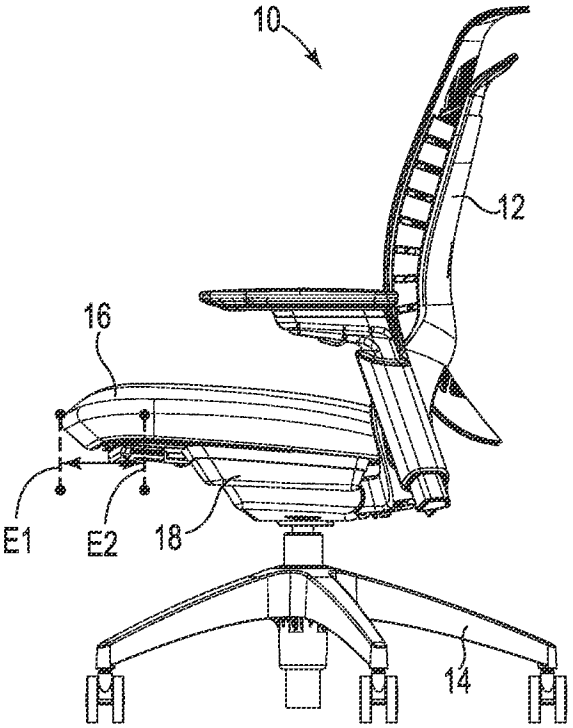
FIG. 34 shows the chair from a side view with the seat assembly in an fully extended state, according to some embodiments.

FIG. 34 illustrates the chair 10 with the seat assembly 16 in a fully extended position E1 relative to the fully retracted position E2, where the chair 10 is shown in the retracted potion in FIG. 33. As previously indicated, upon depression of the front handle 208 of the latch assembly 206, the rear clamp 212 is actuated to facilitate adjustment, or sliding of the seat assembly 16 on the control assembly 18.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A chair control cartridge comprising:

a seat support including a first rider and a second rider;

a link arm including a body and a pivot link, the body having a first end and a second end, the second end being pivotably coupled to the pivot link, the pivot link being pivotably coupled to the seat support; and a control body having a first slot and a second slot, each of the first and second slots extending at a diagonal to horizontal, such that a rearward end of the slot is higher than a forward end of the slot, the first slot receiving the first rider of the seat support and the second slot receiving the second rider of the seat support, such that upon pivoting of the body of the link arm relative to the control body the riders of the seat support traverse the first and second slots, respectively, to raise and lower the seat support.

2. The chair control cartridge of claim 1, wherein the pivot link is pivotably coupled to the first rider.

3. The chair control cartridge of claim 1, wherein an intermediate location on the body of the link arm is pivotably coupled to the control body toward a rear location on the control body.

4. The chair control cartridge of claim 1, wherein the seat support includes a body and the first and second riders each include slider features rotatably coupled to the body.

5. The chair control cartridge of claim 1, wherein the seat support includes a body and the first and second riders each include slider features rotatably coupled to the body.

6. The chair control cartridge of claim 1, wherein the body of the link arm extends rearwardly relative to the control body to provide a back support attachment location.

7. The chair control cartridge of claim 1, wherein the first slot extends in a first direction and the second slot extends in a second direction, the first direction being angularly offset from the second direction.

8. The chair control cartridge of claim 1, wherein the first and second slots extend in substantially parallel directions.

9. The chair control cartridge of claim 1, wherein the pivot link rotates in a first rotational direction upon rotation of the body of the link arm in a second rotational direction that is opposite to the first rotational direction.

10. The chair control cartridge of claim 1, wherein the first and second riders travel in substantially linear paths in the first and second slots, respectively.

11. The chair control cartridge of claim 1, wherein the seat support includes a front end and a rear end, and further wherein the front end of the seat support is raised and lowered at a greater rate than the rear end of the seat support.

12. A chair comprising the chair control cartridge of claim 1, the chair including a base maintaining the chair control cartridge relative to a floor surface; a seat coupled to the seat support; and a back support coupled to the first end of the body of the link arm.

13. A method of making a chair, the method comprising assembling the chair control cartridge of claim 1, coupling the chair control cartridge to a chair base, coupling a seat to the seat support, and coupling a back support to the first end of the body of the link arm.

14. A seating system comprising:

a base for supporting the chair on a floor surface;

a seat for receiving a posterior of a user;

a back support for receiving a back of the user; and a first chair control cartridge comprising:

a seat support including a first rider and a second rider, the seat support coupled to the seat;

a link arm including a body and a pivot link, the body having a first end and a second end, the second end being pivotably coupled to the pivot link, the pivot link being pivotably coupled to the seat support; and a control body coupled to the base, the control body having a first slot and a second slot, each of the first and second slots extending at a diagonal to horizontal, such that a rearward end of the slot is higher than a forward end of the slot, the first slot receiving the first rider of the seat support and the second slot receiving the second rider of the seat support, such that upon pivoting of the body of the link arm relative to the control body the riders of the seat support traverse the first and second slots, respectively to raise and lower the seat support.

15. The seating system of claim 14, wherein the first slot extends in a first direction and the second slot extends in a second direction, the first direction being angularly offset from the second direction.

16. The seating system of claim 14, wherein the first slot extends in a first direction and the second slot extends in a second direction, each of the first and second directions being configured to extend at a non-zero angle relative to the floor surface.

17. The seating system of claim 14, wherein the first chair control cartridge is positioned toward a first side of the seat, the system further comprising a second chair control cartridge coupled to the seat and the back support positioned opposite the first chair control cartridge toward a second side of the seat.

18. A seating system comprising:

a base for supporting the chair on a floor surface;

a seat for receiving a posterior of a user;

a back support for receiving a back of the user; and a first chair control cartridge comprising:

a control body coupled to the base and including a first rider and a second rider, the control body coupled to the seat;

a link arm including a body and a pivot link, the body having a first end and a second end, the second end being pivotably coupled to the pivot link; and a seat support pivotally coupled to the pivot link, the seat support having a first slot and a second slot, each of the first and second slots extending at a diagonal to horizontal, such that a rearward end of the slot is higher than a forward end of the slot, the first slot receiving the first rider of the control body and the second slot receiving the second rider of the control body, such that upon pivoting the body of the link arm relative to the control body the riders of the control body traverse and the first and second slots, respectively to raise and lower the seat support.

* * * * *